US006608985B2

(12) United States Patent
Mochimaru et al.

(10) Patent No.: US 6,608,985 B2
(45) Date of Patent: Aug. 19, 2003

(54) IMAGE-FORMING APPARATUS AND METHOD FOR IMAGE RECORDING ON TWO SIDES OF A MEDIUM USING A POSITIONING MARK

(75) Inventors: Hideaki Mochimaru, Yokohama (JP); Yasukuni Omata, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/960,295

(22) Filed: Sep. 24, 2001

(65) Prior Publication Data

US 2002/0037185 A1 Mar. 28, 2002

(30) Foreign Application Priority Data

Sep. 22, 2000 (JP) ..... P2000-288910
Aug. 22, 2001 (JP) ..... P2001-250332

(51) Int. Cl.[7] ..... G03G 15/16; G03G 15/22
(52) U.S. Cl. ..... 399/309; 399/66; 399/306
(58) Field of Search ..... 399/66, 92, 94, 399/101, 297, 301, 306, 308, 307, 309, 388, 401

(56) References Cited

U.S. PATENT DOCUMENTS

| | | | |
|---|---|---|---|
| 3,724,944 A | | 4/1973 | Sugita et al. |
| 3,765,760 A | | 10/1973 | Mochimaru |
| 3,884,576 A | | 5/1975 | Mochimaru et al. |
| 3,901,586 A | | 8/1975 | Suzuki et al. |
| 4,056,320 A | | 11/1977 | Mochimaru et al. |
| 4,105,326 A | | 8/1978 | Mochimaru |
| 4,535,982 A | | 8/1985 | Mochimaru |
| 4,605,299 A | | 8/1986 | Mochimaru |
| 4,703,334 A | | 10/1987 | Mochimaru et al. |
| 4,753,543 A | | 6/1988 | Mochimaru et al. |
| 4,757,344 A | | 7/1988 | Idenawa et al. |
| 4,875,063 A | | 10/1989 | Idenawa et al. |
| 4,987,446 A | | 1/1991 | Mochimaru et al. |
| 5,027,159 A | * | 6/1991 | Oda et al. ..... 399/309 |
| 5,089,855 A | | 2/1992 | Mochimaru et al. |
| 5,138,363 A | | 8/1992 | Yuge |

(List continued on next page.)

FOREIGN PATENT DOCUMENTS

JP 11-327254 11/1999

OTHER PUBLICATIONS

Patent Abstracts of Japan, JP 10–115954, May 6, 1998.

*Primary Examiner*—Sandra L Brase
(74) *Attorney, Agent, or Firm*—Oblon, Spivak, McClelland, Maier & Neustadt, P.C.

(57) ABSTRACT

An image forming apparatus includes a first image bearing member, a second image bearing member, a positioning mark forming device configured to form a positioning mark on the second image bearing member, and a positioning mark detecting device configured to detect the positioning park formed on the second image bearing member. A first side visual image formed on the first image bearing member is transferred onto the second image bearing member for transferring from the second image bearing member onto a first side of a recording medium. A second side visual image formed on the first image bearing member is transferred from the first image bearing member onto a second side of the recording medium, so that the first and second side visual images are obtained on the first and second sides of the recording medium, respectively. When forming the first side and second side visual images on the first and second sides of the recording medium, an image forming operation is controlled according to detection of the positioning mark with the positioning mark detecting device such that positions of the first side and second side visual images on the first and second sides of the recording medium coincide with each other.

36 Claims, 14 Drawing Sheets

U.S. PATENT DOCUMENTS 5,394,231 A 2/1995 Sudo et al.
5,499,078 A 3/1996 Kurokawa et al.
5,559,590 A 9/1996 Arai et al.
5,570,162 A 10/1996 Sohmiya
5,594,540 A 1/1997 Higaya et al.
5,615,872 A 4/1997 Mochimara
5,619,311 A 4/1997 Kurokawa et al.
5,678,152 A 10/1997 Kohno et al.
5,701,569 A * 12/1997 Kanazawa et al. ..... 399/308
5,832,354 A 11/1998 Kouno et al.
5,890,044 A * 3/1999 Yamashita et al. ..... 399/307
5,899,611 A * 5/1999 Haneda et al. ..... 399/309
5,915,147 A 6/1999 Kouno et al.
5,933,694 A * 8/1999 Yamashita et al. ..... 399/307 X
5,970,277 A * 10/1999 Shigeta et al. ..... 399/306 X
5,970,295 A 10/1999 Samizo
6,038,410 A 3/2000 Iriyama
6,151,057 A 11/2000 Yamazaki et al.
6,173,148 B1 1/2001 Matsuda et al.
6,347,214 B1 2/2002 Kaneko

* cited by examiner

IMAGE-FORMING APPARATUS AND METHOD FOR IMAGE RECORDING ON TWO SIDES OF A MEDIUM USING A POSITIONING MARK

BACKGROUND OF THE INVENTION

1. Field of the Invention

The present invention relates to an apparatus and a method of forming images on both sides of a recording medium.

2. Discussion of the Background

Image forming apparatuses, such as copying machines, printers, facsimile machines, etc. are known to form images on both sides of a recording medium (hereinafter sometimes referred to as a sheet). Such image forming apparatuses capable of recording images on both sides of a sheet generally transfer an image of one side of an original, which has been formed and visualized on an image bearing member, onto one side of a sheet, and fix the image onto the sheet by a fixing device. The sheet is then reversed by a reversing path and is conveyed again so that an image of the other side of the original, which has also been formed and visualized on the image bearing member, is transferred and fixed onto the other side of the sheet.

In the above-described image forming apparatuses, because the sheet conveying direction has to be reversed, a sheet tends to be curled when an image is fixed onto one side of the sheet and reliability of sheet conveyance is hard to obtain.

Japanese Patent Laid-open Publications No. 1-209470, No. 3-253881 and No. 10-142869 disclose an image forming apparatus in which toner images, which have been transferred onto both sides of a sheet from a first image bearing member and a second image bearing member, respectively are fixed at one time.

When forming images on both sides of a recording medium, positions of the images on the front side and the back side of the recording must coincide with each other. For example, when sheets having character images on both sides thereof are bound to be a book, if the positions of respective character images on the front and back sides of each sheet are deviated from each other, the heights of respective lines in the character images in the right side and left side pages do not coincide with each other when the book is opened. This causes difficulty in reading the book and makes the appearance of the book unattractive. This can be said not only for character images but also for graphic images. Further, even in a single sheet having images on both sides thereof, when the images are character images and when the sheet is thin such that the characters on the back side are readable from the front side, if the positions of respective images on the front and back sides of the sheet are deviated from each other, it is hard to read the characters.

In some background image forming apparatuses that form images on both sides of a sheet, slippage of a transfer belt causes deviation in the positions of the images on both sides of a sheet, thereby deteriorating the quality of the images.

Japanese Patent Laid-open Publication No. 11-327254 describes a technology for preventing color deviation in forming a color image. The technology relates to a method of causing positions of a plurality of images of different colors, which are to be superimposed with each other on a same surface of a sheet, to coincide with each other, but does not relate to a method of causing positions of the images on both sides of a sheet to coincide with each other.

SUMMARY OF THE INVENTION

Accordingly, one object of the present invention is to address the above-discussed and other problems.

Accordingly, preferred embodiments of the present invention provide an image forming apparatus and an image forming method that precisely set the image positions on both sides of a recording medium. According to a preferred embodiment of the present invention, an image forming apparatus includes a first image bearing member; a second image bearing member; a positioning mark forming device configured to form a positioning mark on the second image bearing member; and a positioning mark detecting device configured to detect the positioning park formed on the second image bearing member. A first side visual image formed on the first image bearing member is transferred onto the second image bearing member for transferring from the second image bearing member onto a first side of a recording medium. A second side visual image formed on the first image bearing member is transferred from the first image bearing member onto a second side of the recording medium, so that the first and second side visual images are obtained on the first and second sides of the recording medium, respectively. When forming the first side and second side visual images on the first and second sides of the recording medium, an image forming operation is controlled according to detection of the positioning mark with the positioning mark detecting device such that positions of the first side and second side visual images on the first and second sides of the recording medium coincide with each other.

In the above-described image forming apparatus, writing of the second side image on the first image bearing member, or conveyance of the recording medium, may be controlled according to the detection of the positioning mark with the positioning mark detecting device, such that positions of the first side and second side visual images on the first and second sides of the recording medium coincide with each other.

Further, when forming one of the first side and second side visual images on the recording medium, the conveyance of the recording medium may be controlled according to the detection of the positioning mark with the positioning mark detecting device such that a leading edge of one of the first side and second side visual images is placed at a predetermined position on the recording medium. Alternatively, when forming one of the first side and second side images on the recording medium, formation of the positioning mark on the second image bearing member may be omitted.

Further, the above-described image forming apparatus may include a fixing device, and the first side and second side visual images transferred onto the first and second sides of the recording medium may be fixed onto the recording medium, respectively, by the fixing device in a state that the second image bearing member and the recording medium are overlapped with each other.

Furthermore, the above-described image forming apparatus may include an exposure device configured to form a latent image of an image on the first image bearing member; a developing device configured to visualize the latent image formed on the first image bearing member into a visual image; and a transfer device configured to transfer the visual image from the first image bearing member onto the second image bearing member. In this case, a latent image of the positioning mark is formed with the exposure device on the first image bearing member and is developed to a visual image of the positioning mark with the developing device, and the visual image of the positioning mark is transferred from the first image bearing member to the second image bearing member with the transfer device, thereby forming the positioning mark on the second image bearing member.

Still furthermore, the above-described image forming apparatus may include a positioning mark cleaning device configured to remove the positioning mark formed on the second image bearing member. In this case, when the second image bearing member is formed as an endless belt, the positioning mark cleaning device is placed downstream of the positioning mark detecting device in a vicinity thereof in a rotating direction of the second image bearing member formed as the endless belt.

Furthermore, in the above-described image forming apparatus, the positioning mark may be formed at a position outside of an image forming area on the second image bearing member with respect to an image width direction.

Furthermore, a color of the positioning mark may be different from that of a surface of the second image bearing member. In this case, the image forming apparatus may include a positioning mark developing device configured to visualize the positioning mark in a color different from that of the surface of the second image bearing member.

Alternatively, a color of the surface of the second image bearing member may be different from that of the first side visual image transferred from the first image bearing member. When the positioning mark is formed on a part of the second image bearing member at one side thereof at a position outside of an image forming area in an image width direction, a surface of the part of the second image bearing member at one side thereof where the positioning mark is formed may be formed in a color different from that of the first side visual image transferred thereupon from the first image bearing member.

Furthermore, in the above-described image forming apparatus, the positioning mark may be formed at a position outside of an area corresponding to a maximum size of the recording medium on the second image bearing member.

Still furthermore, in the above-described image forming apparatus, the positioning mark may be formed at a position in front of the first side visual image on the second image bearing member.

Further, the above-described image forming apparatus may include a cooling device configured to circulate air to cool the second image bearing member. In this case, the cooling device is not operated when at least one of the positioning mark and the first side visual image on the second image bearing member passes a cooling area of the cooling device.

Furthermore, in the above-described image forming apparatus, the second image bearing member may be formed as an endless belt and arranged so as to extend in a vertical direction. In this case, the positioning mark detecting device is placed such that a sensing surface thereof is substantially in parallel with a surface of the second image bearing member formed as the endless belt.

Further, the image forming apparatus may include a cleaning device configured to clean the second image bearing member, and the cleaning device may remove the positioning mark formed on the second image bearing member.

According to another preferred embodiment of the present invention, an image forming method for obtaining a first side visual image and a second side visual image on a first side and a second side of a recording medium by transferring the first side visual image from a first image bearing member to a second image bearing member and from the second image bearing member onto the first side of the recording medium, and transferring the second side visual image from the first image bearing member to the second side of the recording medium includes the steps of; forming a positioning mark on the second image bearing member; detecting the positioning mark; and controlling formation of the second side visual image according to the detection of the positioning mark on the second image bearing member such that positions of the first side and second side visual images on the first and second sides of the recording medium coincide with each other.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
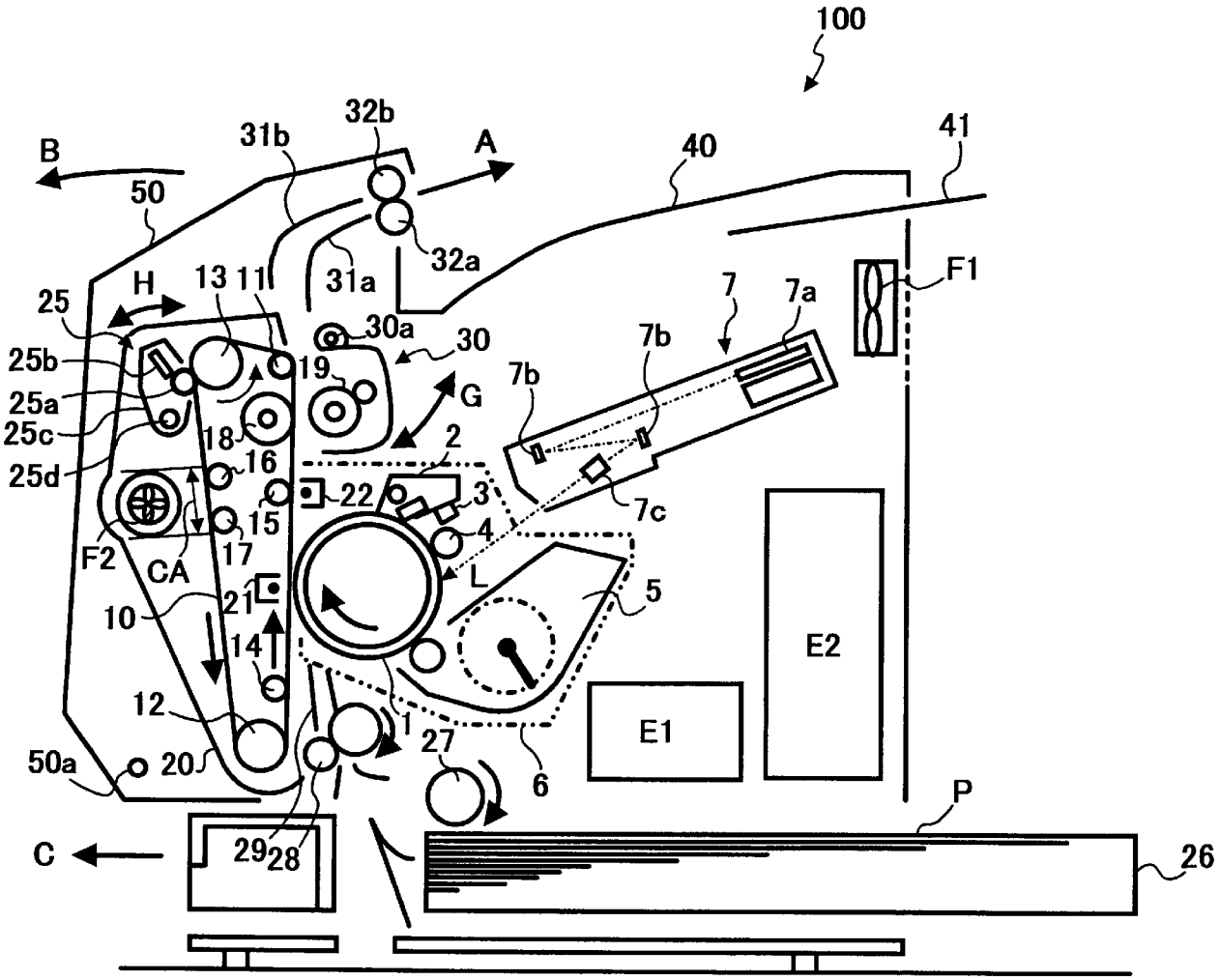
FIG. 1 is schematic drawing of a printer as an example of an image forming apparatus according to a preferred embodiment of the present invention.

Referring now to the drawings, wherein like reference numerals designate identical or corresponding parts throughout the several views, preferred embodiments of the present invention are described.

FIG. 1 is a cross-section illustrating a printer as an example of an image forming apparatus according to a preferred embodiment of the present invention.

A printer 100 includes a process cartridge 6 incorporating a photoconductor drum 1 serving as a first image bearing member substantially at a center thereof. A cleaning device 2, a discharging device 3, a charging device 4, and a developing device 5 are arranged around the photoconductor drum 1. An exposure device 7 is arranged above and at the right side of the process cartridge 6 in FIG. 1. A laser light L emitted by the exposure device 7 irradiates the photoconductor drum 1 at a writing position between the charging device 4 and the developing device 5.

A belt unit 20 is arranged at the left side of the process cartridge 6 in FIG. 1. The belt unit 20 includes an intermediate transfer belt 10 serving as a second image bearing member. The photoconductor drum 1 is arranged so that a part thereof contacts the intermediate transfer belt 10.

The intermediate transfer belt 10 is spanned around and supported by rollers 11, 12, and 13, so as to be rotatable in a counterclockwise direction in FIG. 1. In the embodiment, the roller 13 functions as a driving roller. The intermediate transfer belt 10 is spanned around the rollers 11, 12, and 13 such that a winding angle is obtained relative to the driving roller 13, and thereby a driving force is securely transmitted to the driving roller 13. The driving roller 13 includes, on its outer circumferential surface, a rubber material, such as urethane, which has a superior heat-resisting property. Rubber material can obtain a resisting force relative to the intermediate transfer belt 10, so that slippage between the driving roller 13 and the intermediate transfer belt 10 is prevented when the driving roller 13 is driven. The intermediate transfer belt 10 is heat-resisting and has a resistance value that enables transfer of toner. Preferably, polyimide or polyamide is used as a substrate of the intermediate transfer belt 10.

Rear-side supporting rollers 14 and 15, cooling devices 16 and 17, a fixing roller 18, and a first transfer device 21 are arranged inside of a loop of the intermediate transfer belt 10. The fixing roller 18 includes a heat source, such as with a heater inside thereof, and fixes a toner image, which has been transferred onto a first side of a sheet, onto the sheet. The first transfer device 21 is arranged to oppose the photoconnductor drum 1 while sandwiching the intermediate transfer belt 10 therebetween. The first transfer device 21 transfers a toner image formed on the photoconductor drum 1 onto the intermediate transfer belt 10 or onto the first surface of the sheet. Each of the rollers arranged inside of the loop of the intermediate transfer belt 10 is grounded to a frame of the printer 100.

A second transfer device 22, a fixing device 30, and a belt cleaning device 25 are arranged around the outer circumference of the intermediate transfer belt 10.

The fixing device 30 includes a fixing roller 19 having a heat source, such as with a heater inside thereof, and fixes a toner image, which has been transferred onto a second side of the sheet, onto the sheet. The fixing device 30 is supported so as to be rotatable around a fulcrum 30*a*. The fixing device 30 is rotated in a direction indicated by an arrow G by a rotating device (not shown), so as to be pressed against the fixing roller 18 while sandwiching the intermediate transfer belt 10 and a sheet therebetween, and to be separated from the fixing roller 18

The belt cleaning device 25 for the intermediate transfer belt 10 includes a cleaning roller 25*a*, a blade 25*b*, and a toner conveying device 25*c*. The belt cleaning device 25 removes unnecessary toner remaining on a surface of the intermediate transfer belt 10. The toner deposited in the cleaning device 25 is conveyed to a collecting device (not shown) by the toner conveying device 25*c*. The cleaning device 25 is rotatable in a direction indicated by an arrow H around a rotating fulcrum 25*d*. The cleaning device 25 is rotated by a device (not shown) so that the cleaning roller 25*a* is brought into contact with or separated from the intermediate transfer belt 10.

In the embodiment, as illustrated in FIG. 1, the first and second transfer devices 21 and 22 are arranged at one side of the intermediate transfer belt 10 (i.e., at the right side in FIG. 1). The intermediate transfer belt 10 is configured in the embodiment by the position of the driving roller 13 and the rotation direction of the intermediate transfer belt 10, so that a side of the intermediate transfer belt 10 that contacts the photoconductor drum 1, i.e., a side where a transfer area is located, is a stretched part of the belt 10. Therefore, even when an outer force is unnecessarily given to the intermediate transfer belt 10, the intermediate transfer belt 10 is stably driven at the transfer area, and thereby undesired trouble such as image blurring is avoided.

The process cartridge 6 is constructed by integrally assembling the photoconductor drum (i.e., first image bearing member) 1, the cleaning device 2, the discharging device 3, the charging device 4, and the developing device 5. The process cartridge 6 can be replaced when its expected life span ends.

In the embodiment, the belt unit 20 and the fixing device 30 are also configured to be replaced when their respective life spans end. A front frame 50 of the main body of printer 100 can be opened in a direction indicated by an arrow B around an open/close support axis 50*a* so that replacement work for the process cartridge and clearing work for a jammed sheet are facilitated.

A sheet feeding cassette 26 is arranged at a bottom part of the main body of the printer 100. The sheet feeding cassette 26 can be drawn out in a direction indicated by an arrow C. Transfer sheets P as recording media are accommodated in the sheet cassette 26. A feeding roller 27 is arranged above a tip end side (at a left side end in FIG. 3) of the sheet feeding cassette 6 in a sheet feeding direction. Further, a registration roller pair 28 is arranged below the photoconductor drum 1. A guide member 29 is arranged to guide a sheet P from the registration roller 28 to a transfer position. An electronic unit E1 and a control unit E2 are arranged above the sheet feeding cassette 26 and at a right side part of the main body of the printer 100. A fan F1 is arranged above the control unit E2 for discharging inside air so as to prevent an inside temperature from rising.

A sheet discharging and stacking part 40 is formed at an upper surface of the main body. An auxiliary device 41 is arranged at an end of the discharging/stacking part 40 to be drawn out and pushed back into the main body. Discharging rollers 32*a* and 32*b* are arranged at an uppermost position of the printer 100 to discharge a sheet passed through a fixing operation onto the discharging/stacking part 40. Further, guide plates 31*a* and 31*b* are arranged to guide a sheet separated from the intermediate transfer belt 10 to the discharging rollers 32*a* and 32*b*.

Next, an image forming operation in the above-described embodiment is described.

First, an operation for obtaining images on both sides of a sheet is described. In the description of obtaining images on both sides of a sheet, an image which is first formed is referred to as a first side visual image, and an image which is later formed is referred to as a second side visual image. Further, a sheet side onto which the first side visual image is transferred is referred to as a first sheet side and a sheet side onto which the second side image is transferred is referred to as a second sheet side.

As described above, the image forming apparatus of the embodiment is a printer, in which a signal for writing an image is sent from a host computer (not shown), although the teaching of the present invention can be applied to other types of image forming apparatuses. The exposure device 7 is driven according to an image signal which has been received. Light from a laser light source (not shown) of the exposure device 7 is deflected so as to scan by a polygon mirror 7*a* which is rotated by being driven by a motor. The light is irradiated onto the photoconductor drum 1 which has been uniformly charged by the charging device 4 via a mirror 7*b* and a fθ lens 7*c* so that an electrostatic latent image corresponding to writing information is formed on the photoconductor drum 1.

The latent image on the photoconductor drum 1 is developed by the developing device 5 so that a visual image of toner is formed and carried on a surface of the photoconductor drum 1 as a first side visual image. The first side toner image on the photoconductor drum 1 is transferred by the first transfer device 21, which is provided at a rear side of the intermediate transfer belt 10 functioning as a second image bearing member, onto a surface of the intermediate transfer belt 10, which is being moved in synchronism with the photoconductor drum 1.

The surface of the photoconductor drum 1 is then cleaned of residual toner by the cleaning device 2 and discharged by the discharging device 3 for a subsequent image forming cycle.

Figure 3:
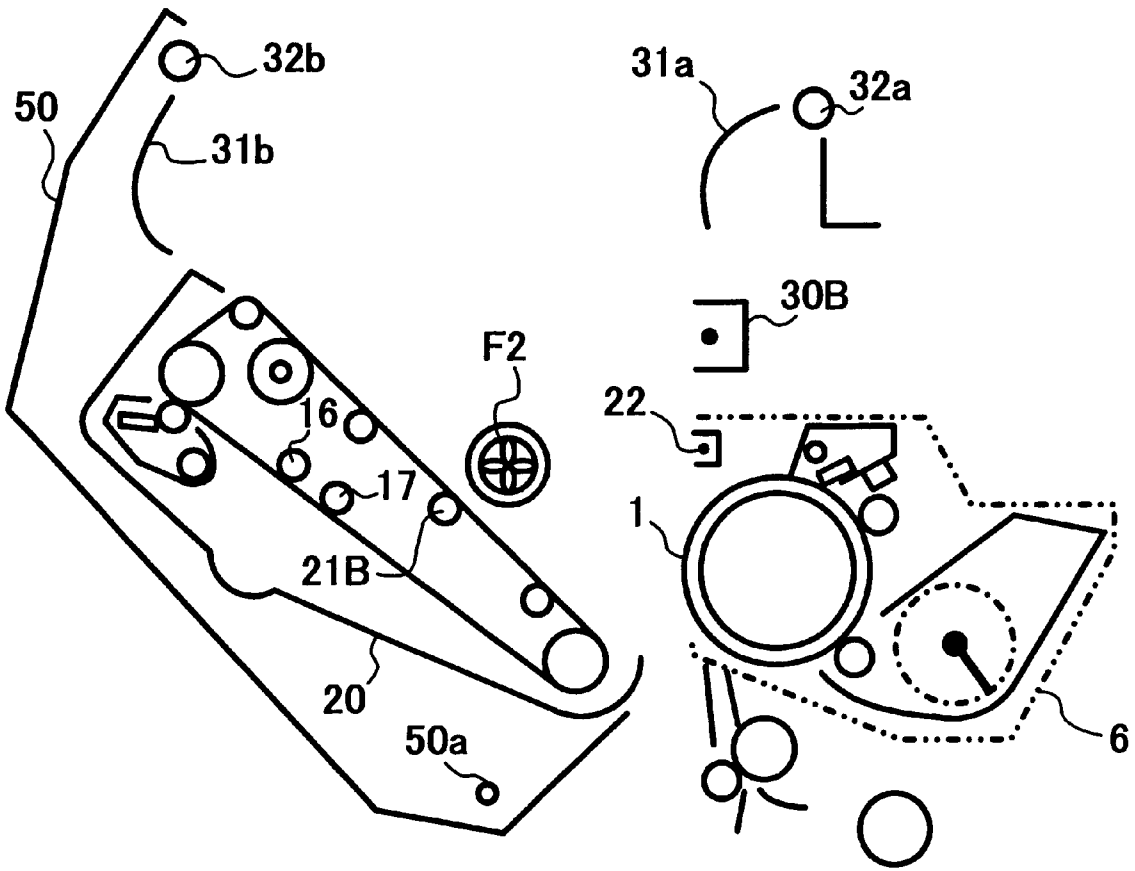
FIG. 3 is a cross-section illustrating a state of the printer of FIG. 2 when a front frame in which a belt unit is incorporated is opened.

The intermediate transfer belt 10 carries the first side toner image transferred thereupon and is driven in the counterclockwise direction in FIG. 3. At this time, so that the toner image on the intermediate transfer belt 10 is not disturbed, the second transfer device 22, the fixing device 30, and the cleaning device 25 are controlled to be in non-operated states, respectively, (i.e., so that each power input thereto is cut off or so as to be separated from the intermediate transfer belt 10).

When the intermediate transfer belt 10 is conveyed so that the toner image thereupon is moved to a predetermined position, a second side image starts to be formed on the photoconductor drum 1 by the above-described process, and sheet feeding starts. By rotation of the feeding roller 27 in the associated arrow direction in FIG. 1, an uppermost sheet P in the sheet feeding cassette 26 is fed out from the sheet feeding cassette 26 to be conveyed to the registration roller pair 28.

The intermediate transfer belt 10 is moved in synchronism with the photoconductor drum 1, so that the first side visual image transferred on the intermediate transfer belt 10 is moved one cycle to be conveyed to a position where the intermediate transfer belt 10 and the photoconductor drum 1 contact each other.

The second side visual image on the photoconductor drum 1 is first transferred by the first transfer device 21 onto a second side of the sheet P which has been conveyed into a position between the intermediate transfer belt 10 and the photoconductor drum 1 via the registration roller pairs 28. The sheet P is conveyed by the registration roller pair 28 at an appropriate timing such that the positions of the sheet P and the second side visual image on the photoconductor drum 1 correctly meet with each other. The positions of the sheet P and the first side visual image on the intermediate transfer belt 10 also correctly meet with each other.

While the second side visual image on the photoconductor drum 1 is being transferred onto the second side of the sheet P, the other side (i.e., first side) of the sheet P is in close contact with and is moved together with the first side visual image on the intermediate transfer belt 10. When the sheet P passes an acting area of the second transfer device 22, a voltage is applied to the second transfer device 22, and thereby the second side visual image on the intermediate transfer belt 10 is transferred onto the sheet.

The sheet onto which the toner images have been transferred on both sides thereof by the actions of the first and second transfer devices 21 and 22 is conveyed to a fixing area of the fixing device 30 as the intermediate transfer belt 10 is rotated. At the fixing area, the fixing device 30 is rotated so that the fixing roller 19 is pressed against and into contact with the fixing roller 18 while sandwiching the intermediate transfer belt 10 therebetween. Thereby, the toner images on both sides of the sheet P are fixed at one time by cooperative work of the fixing roller 19 and the fixing roller 18.

After transfer of the toner images onto both sides of the sheet P, the sheet P is conveyed without being separated from the intermediate transfer belt 10 in a state that the sheet P and the intermediate transfer belt 10 are overlapped with each other, and the toner images are fixed onto the sheet P in such a state. Therefore, the toner images are not disturbed and thereby image blurring is prevented. Further, because the sheet P is conveyed to the fixing area while the sheet P is carried on the intermediate transfer belt 10, the sheet conveying path from the transfer area to the fixing area can be made vertical. Thereby, effective use of an internal space of the printer 100 is enabled, which contributes to reduction of the size of the printer 100. Further, because the fixing area can be arranged above the photoconductor drum 1, the photoconductor drum 1 can be prevented from being affected by heat from the fixing area, and the heat can be advantageously discharged outside of the main body.

The sheet P after passing the fixing area is separated from the intermediate transfer belt 10 at a sheet separation part at the roller 11, and is discharged via the guide members 31*a* and 31*b* to the discharging/stacking part 40 by the discharging roller pair 32*a* and 32*b*. In the embodiment, so that the sheet P is easily separated from the intermediate transfer belt 10 by curvature thereof at the sheet separation part, the radius of the roller 11 used at the sheet separation part is made small and at the same time the intermediate transfer belt 10 is bent about 90° at the roller 11.

When the sheet discharging/stacking part 40 is configured as illustrated in FIG. 1, a sheet is discharged to the discharging/stacking part 40 with a side of the sheet on which an image is to be later formed (i.e., an image which is directly transferred from the photoconductor drum 1 to the sheet) positioned faced down. Therefore, in order to stack sheets carrying images on both sides of the sheets in a correct order of pages on the discharging/stacking part 40, an image of the second page of an original must be first formed to be transferred onto the intermediate transfer belt 10, and thereafter, an image of the first page of the original is formed to be directly transferred from the photoconductor drum 1 onto the sheet. Accordingly, in order to stack sheets carrying images on both sides of the sheets in a correct order of pages on the discharging/stacking part 40, the first side visual image must be an image of the second page of an original and the second visual image must be an image of the first page of the original. Namely, when an image exists on an even-numbered page of an original, the image on the even-numbered page is first formed so as to be transferred onto the intermediate transfer belt 10, and thereafter an image on the preceding odd-numbered page is formed so as to be directly transferred from the photoconductor drum 1 onto the sheet.

When a mirror image is formed on the photoconductor drum 1 and the image is directly transferred onto a sheet, the image is obtained as a correct image on the sheet. When an image formed on the photoconductor drum 1 is once transferred onto the intermediate transfer belt 10 and is then transferred onto a sheet, if the image is formed on the photoconductor drum 1 as a mirror image, the image is obtained on the sheet as the mirror image. Therefore, in the embodiment, the exposure is performed such that the first side visual image, which is transferred from the intermediate transfer belt 10 to a sheet, is formed on the photoconductor drum 1 as a correct image, and the second side visual image, which is directly transferred from the photoconductor drum 1 onto the sheet, is formed as a mirror image on the photoconductor drum 1.

The above-described order of image formation for obtaining correctly arranged pages can be realized by a known technology to store image data in a memory. Exposure switching between correct image and mirror image formations can be also realized by a known image processing technology.

The cleaning device 25 separated from the intermediate transfer belt 10 is rotated, after an image is transferred from the intermediate transfer belt 10 to a sheet, such that the cleaning roller 25*a* of the cleaning device 25 contacts the intermediate transfer belt 10. Residual toner on the intermediate transfer belt 10 is moved onto the cleaning roller 25*a* and then scraped off the cleaning roller 25*a* by the blade 25*b*. The scraped off toner is then collected by the toner conveying device 25*c* to be conveyed to an accommodation part (not shown). The above-described residual toner, which has been heated by the fixing rollers 18 and 19, is easily moved to the cleaning roller 25*a* before the residual toner is cooled. Therefore, the above cleaning is preferably performed upstream of the cooling devices 16 and 17. Iron, stainless steel, or aluminum is preferable for the cleaning roller 25*a*. A thin plate member of steel or stainless steel may be used for the blade 25*b*.

The intermediate transfer belt 10 passed the cleaning area of the cleaning device 25 is cooled by the operation of the cooling devices 16 and 17. The cooling devices 16 and 17 may use various heat radiating systems. In the embodiment, a heat pipe is used for each of the cooling devices 16 and 17, and the cooling devices 16 and 17 directly contact the internal surface of a loop of the intermediate transfer belt 10 to absorb heat therefrom. In the embodiment, further, as illustrated in FIG. 3, a fan F2 is arranged at a part of the printer 100 at one side (i.e., at the left side of the cooling devices 16 and 17 in the figure) to suck in outside air from the other side of the printer 100 and circulate the air along the surface of the intermediate transfer belt 10 in the axial direction of the cooling devices (i.e., heat pipes) 16 and 17 from the one side to the other side of the printer 100 to discharge the heat from the belt unit 20. A duct (not shown) may be arranged to enclose the fan F2 and to extend in the axial direction of the cooling devices 16 and 17 so that the sucked air is circulated along the surface of the intermediate transfer belt 10 as noted above. When an air circulating system is used, such as the fan F2, air is preferably circulated by the fan F2 after the toner images on the intermediate transfer belt 10 have been transferred onto a sheet so that the toner images on the intermediate transfer belt 10 are not disturbed by the air. In particular, when the toner images on the intermediate transfer belt 10 pass a cooling area CA where the air is circulated as noted above along the surface of the intermediate transfer belt 10 in the axial direction of the cooling devices 16 and 17, the air circulating system, i.e., the fan F2, is preferably stopped.

Next, an operation of the printer 100 when obtaining an image on one side of a sheet is described.

When obtaining an image on one side of a sheet, a transfer process to transfer a toner image onto the intermediate transfer belt 10 is omitted, and the toner image formed on the photoconductor drum 1 is directly transferred onto a sheet. When forming an image on one side of a sheet, a toner image on the photoconductor drum 1 is a mirror image, which turns into a correct image when transferred onto the sheet.

In FIG. 1, a sheet P is conveyed to between the photoconductor drum 1 and the intermediate transfer belt 10 in synchronism with a toner image formed on the photoconductor drum 1, and the toner image is transferred by the first transfer device 21 onto the sheet P from the photoconductor drum 1.

The second transfer device 22 is not operated, and the sheet P is moved together with the intermediate transfer belt 10, so that the toner image is fixed onto the sheet P by the fixing device 30. Thereafter, the sheet P is separated from the intermediate transfer belt 10, and is then discharged in the direction A, via the guide members 31*a* and 31*b* and the discharging roller pair 32, so as to be stacked in the discharging/stacking part 40 with the side of the sheet P carrying the image faced down. Thus, when images of multiple pages of an original document are processed in order of pages starting with the first page, the sheets P on which toner images of the images of the multiple pages of the original document are carried are in order of pages when the sheets P are taken out of the discharging/stacking part 40.

Figure 2:
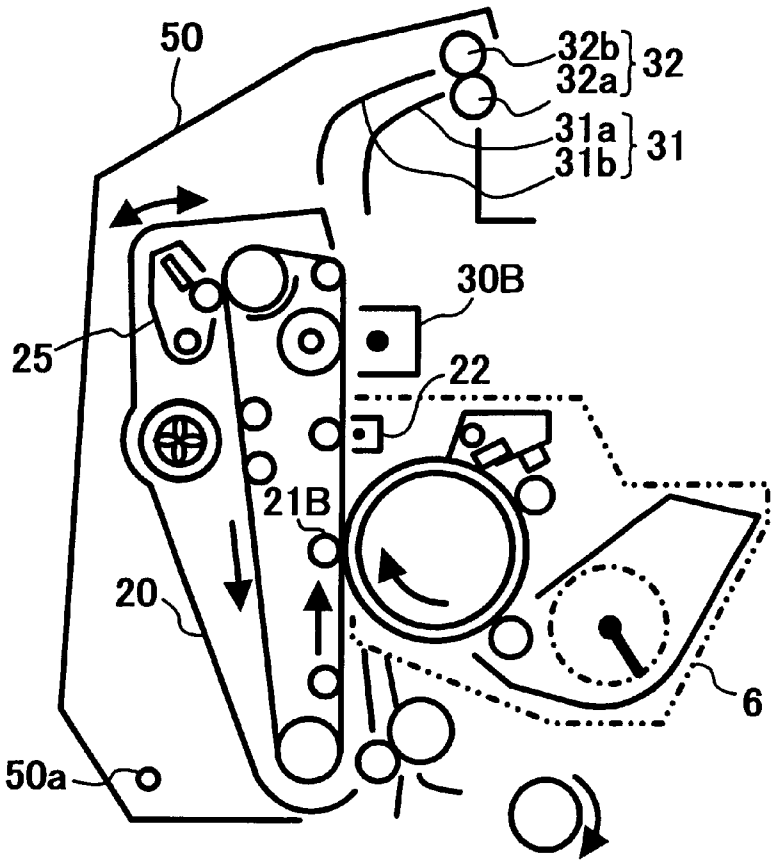
FIG. 2 is a cross-section of a printer according to another preferred embodiment of the present invention, in which a first transfer device is configured to be a contact type and a fixing device is configured to be a non-contact type.

FIG. 2 is a cross-section illustrating an image forming apparatus according to another preferred embodiment of the present invention, in which the first transfer device 21 is configured to be a contact type and the fixing device 30 is configured to be a non-contact type.

In this embodiment, the first transfer device 21 is configured to be a roller type device which contacts the intermediate transfer belt 10 (i.e., a transfer roller 21B). The transfer roller 21B presses the intermediate transfer belt 10 against the photoconductor drum 1 from the inside of a loop of the intermediate transfer belt 10.

The fixing device 30B is a non-contact type which does not contact a sheet being conveyed. The fixing device 30B fixes a toner image by, e.g., irradiation of an infrared or xenon lamp. Because the fixing device 30B is a non-contact type, the fixing device 30B does not need to be rotatable, and therefore in the embodiment is fixed.

The construction of the printer 100 is substantially the same as that of FIG. 1 except for the first transfer device 21B and the fixing device 30B. Also, the image forming operation is substantially the same as in the previous embodiment, and therefore the description thereof is omitted. Because the fixing device 30B is a non-contact type, the fixing device 30B does not operate to contact and separate from the intermediate transfer belt 10 as in the previous embodiment.

FIG. 3 is a cross-section illustrating a state of the printer 100 when the front frame 50 in which the belt unit 20 is incorporated is opened. As in the embodiment illustrated in FIG. 1, the front frame 50 is configured to be rotatable around the open/close support axis 50*a,* and can be opened when removing a jammed sheet or when performing a maintenance work.

As illustrated in FIG. 3, when the front frame 50 is opened, the belt unit 20 is separated from the photoconductor drum 1, the second transfer device 22, and the fixing device 30B (i.e., in the embodiment of FIG. 1, the fixing device 30). Further, the guide plate member 31*b* of a guide member 31 and the discharging roller 32*b* of a discharging roller 32 at one side are each separated from the guide plate member 31*a* of the guide member 31 and the discharging roller 32*a* of the discharging roller 32 at the other side. Thereby, a sheet conveying path is opened, so that removing of a jammed sheet and maintenance work are facilitated. The fan F2 used for cooling the intermediate transfer belt 10 in cooperation with the cooling devices 16 and 17 is provided to a frame separate from the front frame 50. In a state that the front frame 50 is closed, the fan F2 and the cooling device 16 and 17 cooperate with each other to perform a cooling function. In the embodiment of FIG. 1 also, the state that the front frame 50 is opened is substantially the same as illustrated in FIG. 3.

When obtaining images on both sides of a sheet, the positions of respective images on the front and back sides of the sheet need to coincide with each other. For example, when sheets having character images on both sides thereof are bound to be a book, if the positions of respective character images on the front and back surfaces of each sheet are deviated from each other, when the book is opened, the heights of respective lines in the character images in the right side and left side pages differ from each other. This causes difficulty in reading the book, and also makes the appearance of the book unattractive. This can be said not only for character images but also for graphic images. Further, even in a single sheet having images on both sides thereof, when the images are character images and when the sheet is thin such that the characters on the back side are readable from the front side, if the positions of respective images on the front and back surfaces of the sheet are deviated from each other, it is hard to read the characters.

The present invention addresses the above-described inconvenience, and proposes to form on the intermediate transfer belt 10 a mark for causing the positions of the images on both sides of a sheet to coincide with each other accurately and by controlling the image forming operation in accordance with a result of detecting the mark.

Figure 4:
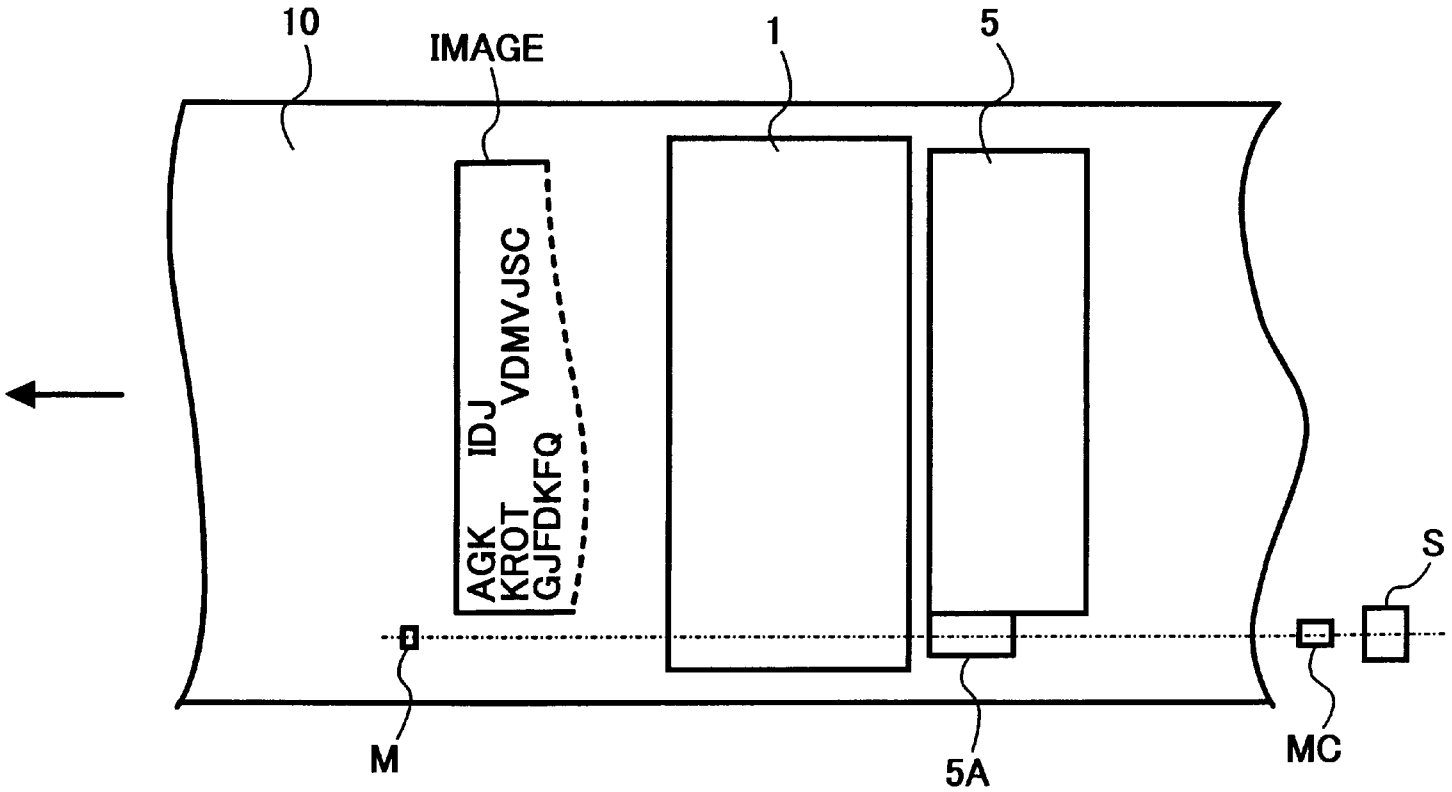
FIG. 4 is a diagram illustrating an example of a positioning mark formed on an intermediate transfer belt.

In this embodiment, the positioning mark is formed on the intermediate transfer belt 10 by forming a toner image serving as the positioning mark on the photoconductor drum 1 by the exposure device 7, and then transferring the toner image onto the intermediate transfer belt 10. FIG. 4 illustrates an example of the positioning mark formed on the intermediate transfer belt 10.

In FIG. 4, the intermediate transfer belt 10 is illustrated associated with the photoconductor drum 1 and the developing device 5. The intermediate transfer belt 10 is conveyed from the right side to the left side in FIG. 4. As illustrated in FIG. 4, a positioning mark M is formed in front of an image transferred onto the intermediate transfer belt 10. The positioning mark M is formed by applying toner onto an electrostatic latent image formed on the photoconductor drum 1 to visualize the latent image with a mark developing device 5A provided to the developing device 5, and then transferring the visualized toner image onto the intermediate transfer belt 10. The positioning mark M can be formed in any shape, but a line shape is preferable, because such a line shape can be easily written on the photoconductor drum 1, and further the visualized toner image of the line shape can be easily removed from the intermediate transfer belt 10.

The mark developing device 5A contains a toner of different color from the intermediate transfer belt 10, so that the color of the positioning mark M is different from that of the intermediate transfer belt 10. Thereby, detection of the positioning mark M with a sensor S (described later) can be securely performed. Because the intermediate transfer belt 10 contains carbon, etc. for obtaining a necessary resistance value, the color of the intermediate transfer belt is often black or a color close to black. Therefore, in this embodiment, instead of developing the positioning mark M with black toner (toner of the developing device 5) that is most frequently used in monochrome printers, the positioning mark M is developed with a toner of different color from that of the intermediate transfer belt 10, i.e., other color than black, by providing the mark developing device 5A dedicated for development of the positioning mark M.

Alternatively, instead of providing the mark developing device 5A exclusively for developing a positioning mark, the color of the intermediate transfer belt 10 can be made different from the color of the toner for the developing device 5 (e.g., black), for example, by coating the surface of the intermediate transfer belt 10. The color of the intermediate transfer belt 10 can be made different from that of the toner of the developing device 5 only at a part of the belt 10 near an edge part thereof where the positioning mark M is formed. When the color of the intermediate transfer belt 10 is made different from that of the toner of the developing device 5, the mark developing device 5A need not be provided, and the positioning mark M can be developed with the developing device 5.

In transferring the positioning mark M onto the intermediate transfer belt 10, the first transfer device 21 (see FIG. 1) is used. The positioning mark M is formed at a position immediately before an image in the direction the intermediate transfer belt 10 is conveyed (i.e., in the sub-scanning direction) and at one side in the intermediate transfer belt 10 outside of the area of the image in the image width direction (i.e., in the main scanning direction). That is, the positioning mark M is formed outside of an image forming area on the intermediate transfer belt 10. Preferably, the positioning mark M should be formed outside of the image forming area relative to a recording sheet of a maximum size which can be used in the printer 100, so that the positioning mark M is not unnecessarily transferred onto a recording sheet. In FIG. 4, the positions of the sensor S for detecting the positioning mark M transferred onto the intermediate transfer belt 10 and a mark cleaning device MC in the belt-width direction are also illustrated. The positions of the sensor S and the mark cleaning device MC in the circumferential direction of the belt 10 are illustrated in FIGS. 5A–5D.

Now, referring to FIGS. 5A–5D, the image forming process of the printer 100 when recording images on both sides of a sheet, and the positioning mark M are described. Here, the description is made in accordance with the embodiment illustrated in FIG. 2 in which the fixing device is a non-contact type (i.e., the fixing device 30B) and the first transfer device is a contact type (i.e., the transfer roller 21B).

Figure 5B:
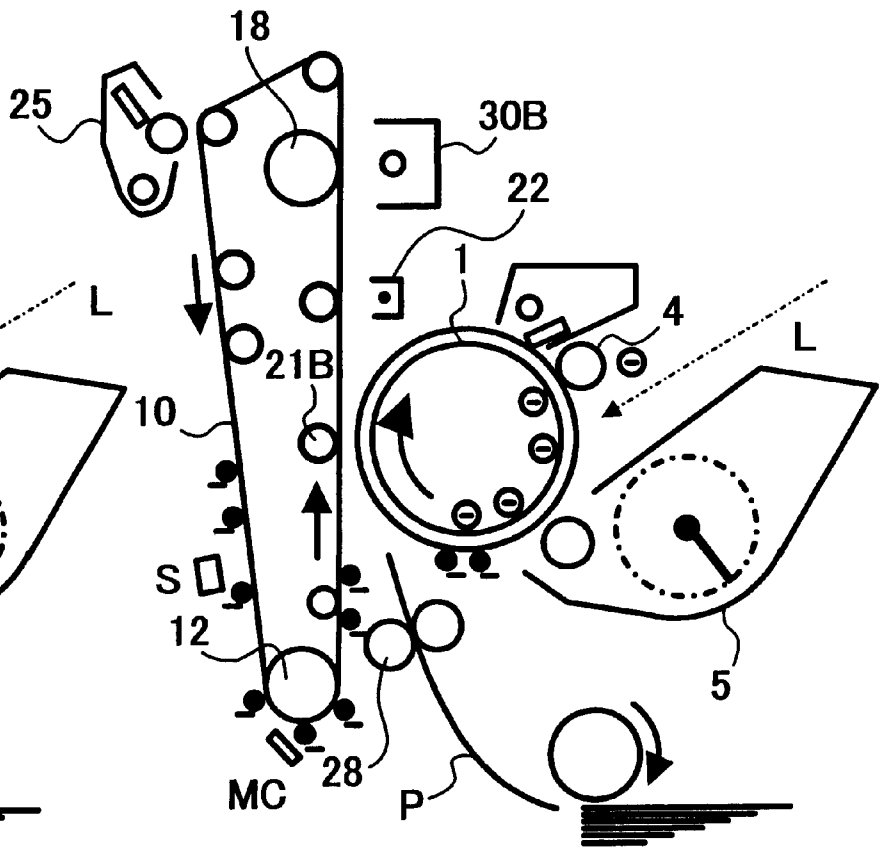
FIGS. 5A–5D are cross-sections conceptually illustrating image forming processes of the printer of FIG. 1 when recording images on both sides of a sheet.
Figure 5A:
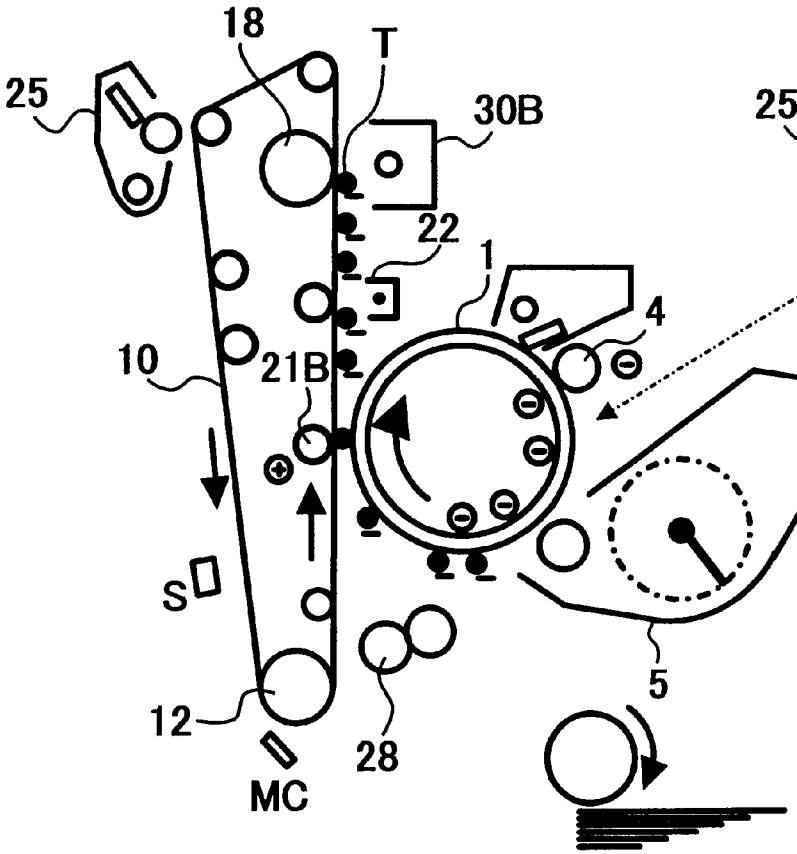
Figure 5D:
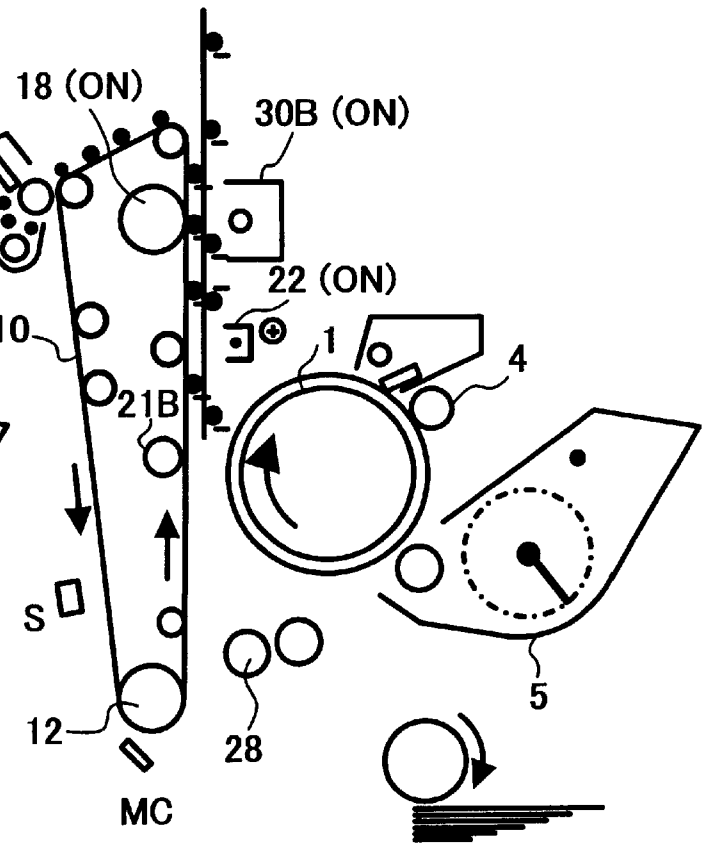
Figure 5C:
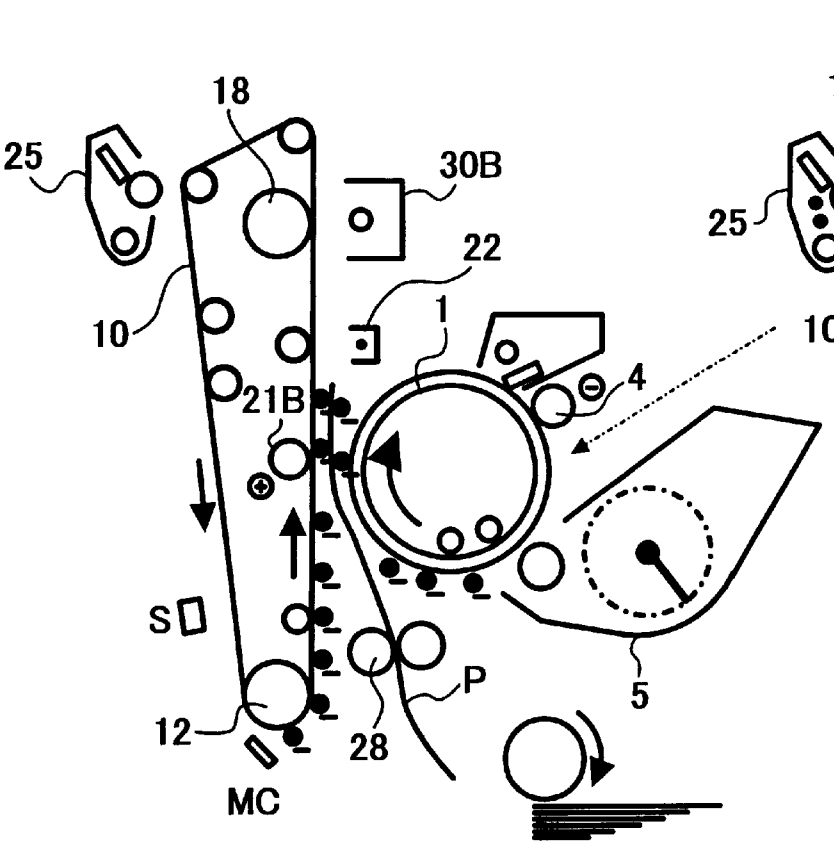

FIG. 5A illustrates processes of first developing (i.e., of a first side visual image) and first transferring (i.e., of the first side visual image to the intermediate transfer belt 10), FIG. 5B illustrates a process of second development (i.e., of the second side visual image), FIG. 5C illustrates a process of second transferring (i.e., of the second side visual image to a sheet), and FIG. 5D illustrates processes of third transferring (i.e., of the first side visual image to the sheet), fixing and belt cleaning. For convenience, in each of FIGS. 5A–5D, the photoconductor drum 1 and the intermediate transfer belt 10 are illustrated separated from each other, however, the photoconductor drum 1 and the intermediate transfer belt 10 are arranged so as to contact each other.

In FIG. 5A, the charging device 4 negatively charges the photoconductor drum 1, and an electrostatic latent image is formed on the photoconductor drum 1 by a writing light L from the exposure device 7. The writing light L includes, in addition to image information of a first side visual image of an image to be recorded on a sheet, information corresponding to the positioning mark M. As described above, optical writing of the positioning mark M on the photoconductor drum 1 is performed such that a latent image of the positioning mark M is formed outside of an image forming area of the photoconductor drum 1. At the same time, optical writing of the image information of the first side visual image is also performed so as to form a latent image of the image information of the first side visual image on the photoconductor drum 1. Then, negatively charged toner (i.e., illustrated in a black circle) is applied by the developing device 5 to the electrostatic latent images of the first side visual image and the positioning mark M on the photoconductor drum 1. The toner images of the first side image and the positioning mark M are then transferred onto the intermediate transfer belt 10 by the action of the first transfer device 21B to which a positive voltage is applied.

In FIG. 5B, a toner image of the second side visual image, which is negatively charged, is formed on the photoconductor drum 1, and the first side toner image and the positioning mark toner image carried on the intermediate transfer belt 10 are moved toward a position near a contacting part between the photoconductor drum 1 and the intermediate transfer belt 10 after making one round.

The sensor S for detecting the positioning mark M is arranged slightly upstream of the driven roller 12 in the belt conveying direction. The sensor S in this embodiment is, for example, a photo-sensor having a light emitting part and a light receiving part. The positioning mark cleaning device MC for removing the positioning mark M from the intermediate transfer belt 10 is configured to be a blade type. In FIGS. 5A–5D, only a blade of the positioning mark cleaning device MC is illustrated and illustration of a case for collecting the removed toner is omitted.

When the positioning mark M carried on the intermediate transfer belt 10 reaches the position of the sensor S, the positioning mark M is detected by the sensor S, which is recognized by a CPU of the controller unit E2 of the printer 100. According to a detect signal of the sensor S, optical writing of a next image (i.e., second side image) and feeding of a sheet are started. These controls will be described later referring to a timing chart. FIG. 5B illustrates a state that formation of the next image (i.e., the second side visual image) is started and a sheet P starts to be conveyed from the registration roller 28.

After the sensor S detects the positioning mark M and a trigger signal is generated by the sensor S, the positioning mark M is not necessary any more. Therefore, the positioning mark cleaning device MC removes the positioning mark M from the intermediate transfer belt 10. If the positioning mark M is not removed from the intermediate transfer belt 10, in the printer 100 having a configuration in which the fixing operation is performed while a recording sheet is overlaid on the intermediate transfer belt 10, in particular in the configuration of FIG. 1, the toner forming the positioning mark M is fixed onto the intermediate transfer belt 10 during the process of fixing the toner images onto the recording sheet, thereby causing a problem. Accordingly, after the sensor S detects the positioning mark M, the positioning mark M is removed from the intermediate transfer belt 10 by the positioning mark cleaning device MC.

As described above, the positioning mark M is formed outside of the image forming area on the photoconductor drum 1 so as to be located outside of the image area on the intermediate transfer belt 10 in the belt-width direction. Accordingly, the positioning mark cleaning device MC is also located at a position outside of the image area on the intermediate transfer belt 10 in the belt-width direction, and therefore, the positioning mark cleaning device MC can be configured to always contact the intermediate transfer belt 10. In FIGS. 5A–5D, the blade of the positioning mark cleaning device MC is separated from the intermediate transfer belt 10. However, in actuality, the blade of the positioning mark cleaning device MC is configured to contact the intermediate transfer belt 10. It is needless to say that the blade of the positioning mark cleaning device MC can be configured to contact and separate from the intermediate transfer belt 10, although the configuration and control of which may be slightly complicated. As the positioning mark cleaning device MC, any type of device can be used (e.g., a roller, a fur brush, etc.). By arranging the positioning mark cleaning device MC at a position corresponding to the position where a roller (in the embodiment, the driven roller 12) is arranged at the rear side of the intermediate transfer belt 10, removal of the positioning mark M from the intermediate transfer belt 10 can be securely performed.

When a non-contact type fixing device is used as in the embodiment of FIG. 2, if the fixing device is arranged so as to be sufficiently separated from the intermediate transfer belt 10 such that the positioning mark M on the intermediate transfer belt 10 cannot be fixed onto the intermediate transfer belt 10 by the fixing device, the positioning mark M can be removed from the intermediate transfer belt 10 with the cleaning device 25 without a need of removing the positioning mark M in advance. In this case, the positioning mark cleaning device MC can be omitted. The provision of the positioning mark cleaning device MC avoids imposing an additional burden on the cleaning device 25 and thereby increasing the size of the cleaning device 25.

In this embodiment, the intermediate transfer belt 10 is arranged to extend in a vertical direction so that a recording sheet is conveyed in the vertical direction, and the sensor S is arranged to face the intermediate transfer belt 10 such that the sensing surface of the sensor (i.e., the surfaces of the light emitting and receiving parts of the sensor S) are substantially in parallel with the surface of the intermediate transfer belt 10. Therefore, depositing of dust or toner on the surface of the sensor S is avoided and thereby deterioration of the detection performance over the period of time is avoided.

In FIG. 5C, the second side image on the photoconductor drum 1, which is negatively charged, is transferred onto the sheet P (i.e., second transferring) by the action of the first transfer device 21B to which a positive voltage is applied. At this time, the first side of the sheet P is overlapped with the first side visual image on the intermediate transfer belt 10. In the embodiment, a belt having an intermediate resistivity is used for the intermediate transfer belt 10 serving as the second image bearing member, and the sheet P is held by the intermediate transfer belt 10 by an electrostatic charge opposing an electric charge of the sheet P. Therefore, a bias voltage is not applied.

In FIG. 5D, the first side toner image on the intermediate transfer belt 10, which has been negatively charged, is transferred onto the sheet P (i.e., second transferring) by the action of the second transfer device 22 to which a positive voltage is applied. Further, the sheet P is conveyed to the fixing area while being held on the intermediate transfer belt 10, and the toner images are fixed onto both sides of the sheet P by turning on heating of the fixing devices 18 and 30B which are arranged on both sides of the intermediate transfer belt 10. The belt cleaning device 25 is pressed against the intermediate transfer belt 10 to remove residual toner on the intermediate transfer belt 10.

Figure 6:
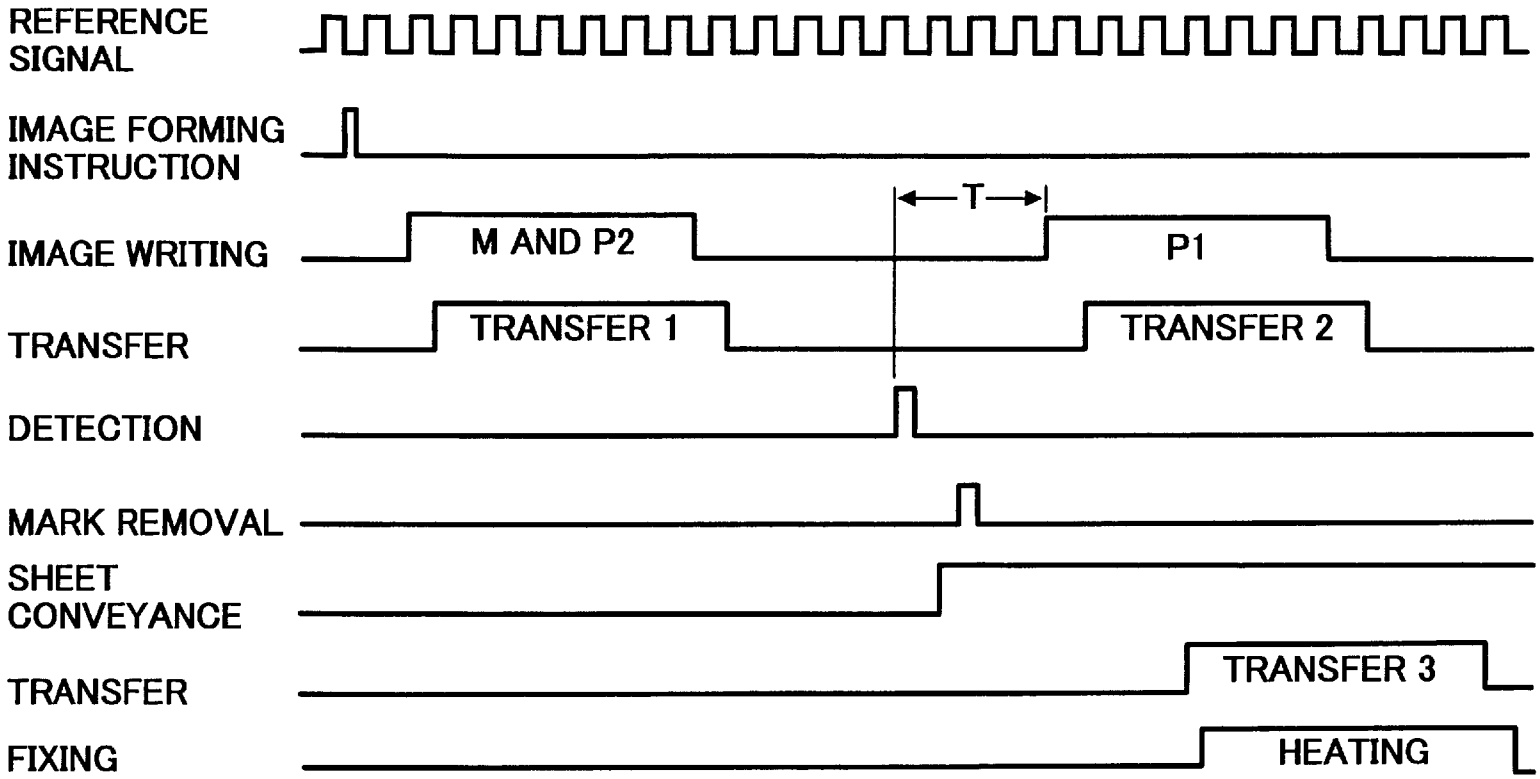
FIG. 6 is a timing chart illustrating operation timings of the printer when forming images on both sides of a sheet.

FIG. 6 is a timing chart illustrating operation timings of the printer 100 when obtaining images on both sides of a sheet.

In FIG. 6, after an image forming instruction is given, image writing for the positioning mark M and a second page image P2 (i.e., the first side visual image) is performed, and then development (not shown in FIG. 6) and transfer of the images of the positioning mark M and the second page P2 to the intermediate transfer belt 10 (transfer 1) are performed. Subsequently, a sheet is fed out by the registration roller 28 according to a detect signal of the sensor S, and after a predetermined time (T) after the detect signal of the sensor S, image writing, development (not shown), and direct transfer to the sheet (transfer 2) of an image of the first page (i.e., the second side visual image) are performed. Also, removal of the positioning mark M from the intermediate transfer belt 10 with the positioning mark cleaning device MC is performed. Further, the first side visual image is transferred from the intermediate transfer belt 10 to the first side of the sheet (transfer 3), and the fixing rollers 18 and 19 (or 30B) are heated to fix the toner images on both sides of the sheet at one time.

In this embodiment, because timings of formation (i.e., writing, development, and transfer) of a next image and a timing of conveyance of a sheet are determined in accordance with a detect signal of the sensor S, even when slippage of the intermediate transfer belt 10 occurs before the positioning mark M is detected by the sensor S, for example, the first side visual image on the intermediate transfer belt 10 and the second side visual mage on the photoconductor drum 1 are formed so as to correctly coincide with each other on a recording sheet. It is more advantageous to arrange the sensor S at a downstream side of the first transfer device 21 or 21B as much as possible in the belt conveyance direction, so long as the next image can be formed in time.

In this embodiment, the positioning mark M is formed with the exposure device 7 that is also used for forming an image to be recorded on a recording sheet. Accordingly, the positioning mark M can be formed positionally associated with the image for recording, so that positioning of the images on both sides of a recording sheet so as to be coincided with each other can be precisely performed.

Further, in this embodiment, the positioning mark M is not fixedly provided on the intermediate transfer belt 10. When the positioning mark M is fixedly provided on the intermediate transfer belt 10 as in some of the background apparatuses, in transferring the toner image of an image for recording onto the intermediate transfer belt 10, the toner image must be transferred onto the intermediate transfer belt 10 while avoiding the toner image from being transferred onto the part of the intermediate transfer belt 10 where the positioning mark M is fixedly provided. This decreases the productivity of the printer 100. In this embodiment, because a toner image of the positioning mark M is formed each time when a toner image of an image for recording is formed, the toner images of the positioning mark M and the image for recording can be transferred to any position on the intermediate transfer belt 10 in the belt conveyance direction. Thus, the productivity of the printer 10 is not decreased by provision of the positioning mark M.

Figure 7:
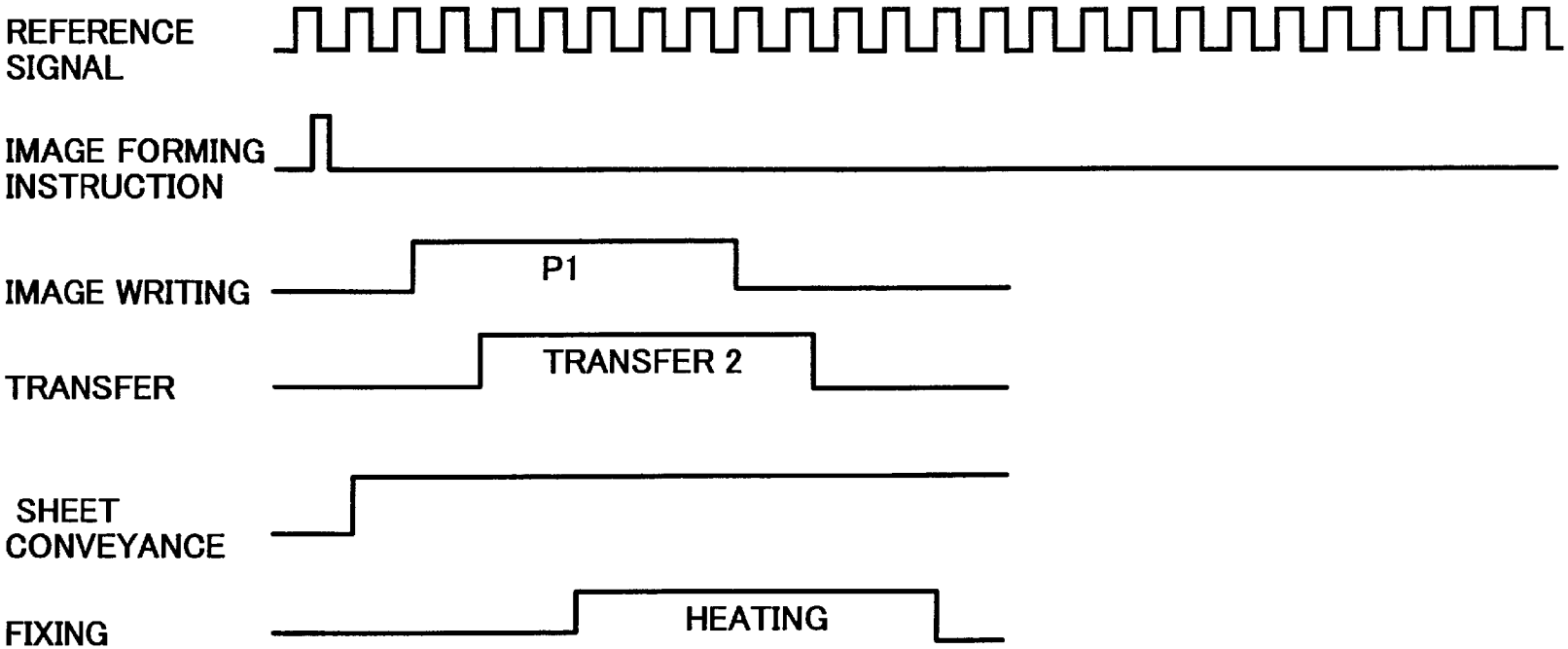
FIG. 7 is a timing chart illustrating operation timings of the printer when forming an image on one side of a sheet.
Figure 8A:
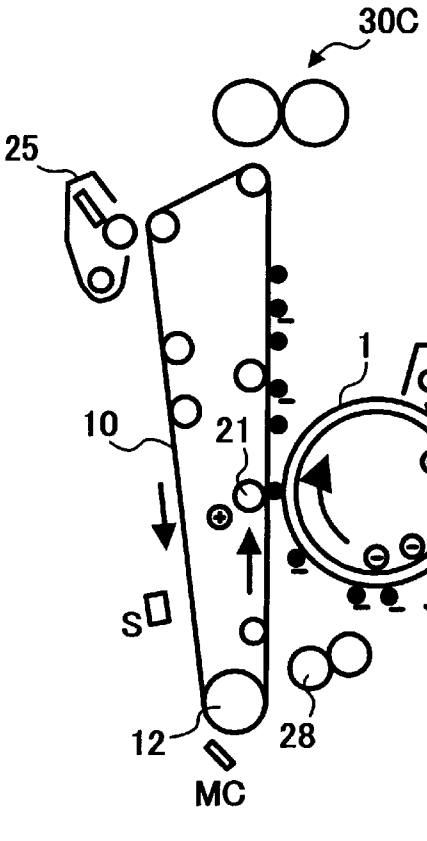
FIGS. 8A–8D are cross-sections conceptually illustrating image forming processes of a printer having a fixing device of a different configuration from the printer of FIG. 1 when forming images on both sides of a sheet.
Figure 8B:
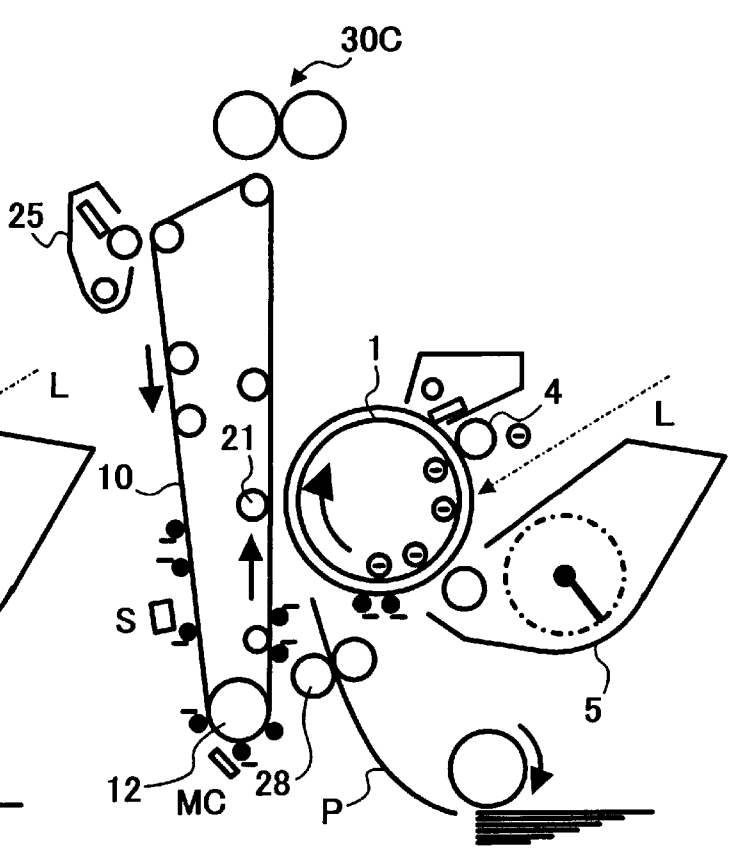
Figure 8D:
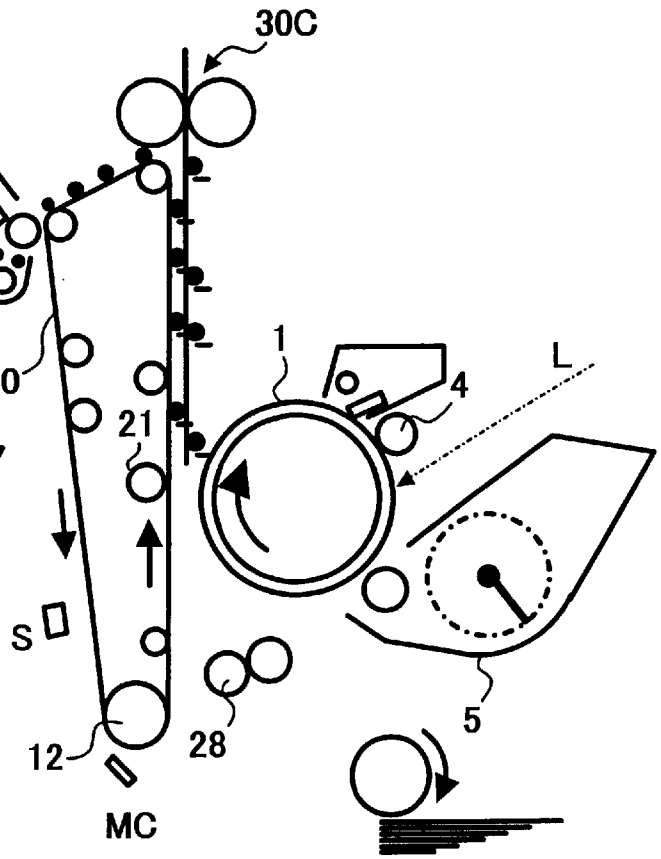
Figure 8C:
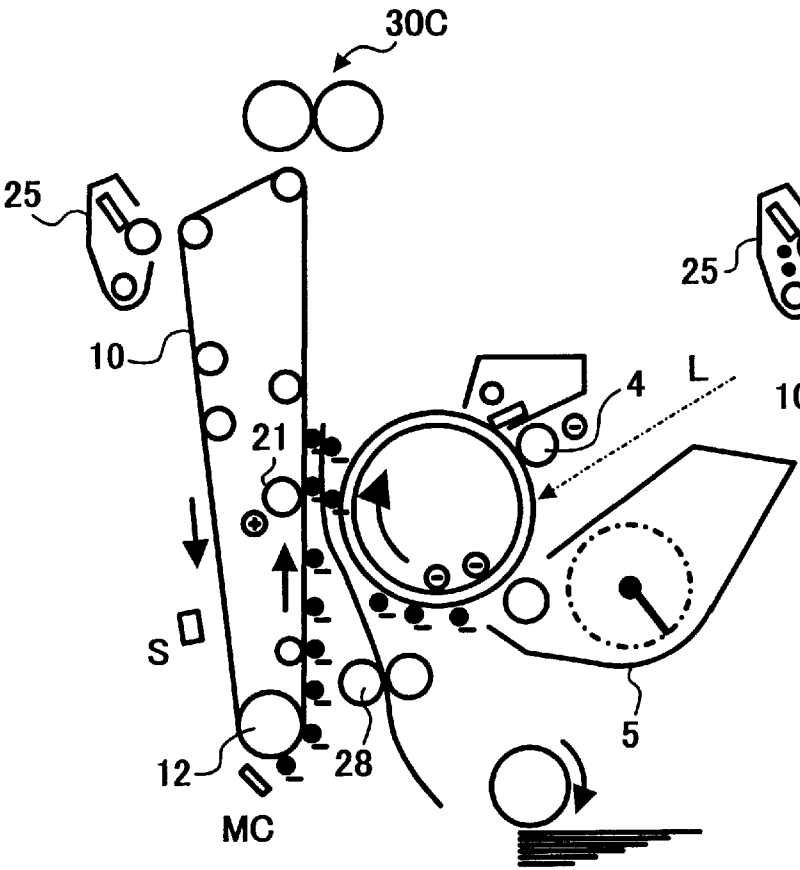

FIG. 7 is a timing chart illustrating operation timings of the printer 100 when forming an image on one side of a sheet.

In FIG. 7, after an image formation instruction is given, a sheet P is fed out by the registration roller 28. Then, image writing for an image of the first page is performed, and subsequently, development of a latent image of first page image (not shown) with toner and direct transfer of a toner image of the first page image onto the sheet P (transfer 2) are performed. The fixing rollers 18 and 19 (or 30B) are heated to fix the toner image on the sheet P onto the sheet P. Further, cleaning of the intermediate transfer belt 10 is performed (not shown), and cooling of the intermediate transfer belt 10 is also performed (not shown). When the second and subsequent pages exist, substantially the same operation as the one for the first page is repeated.

In forming an image on one side of a sheet, it is not necessary to cause the positions of images on both sides of the sheet to coincide with each other. Therefore, although it is necessary to accomplish accuracy in the distance between a leading edge of an image and that of a recording sheet, formation of the positioning mark M is not necessary. The control of conveyance of a recording sheet and clutch connection and separation for the registration roller 28 can be sufficiently performed by a reference signal.

FIGS. 8A–8D illustrate a configuration of the printer 100 in which a fixing device 30C is arranged outside of a loop of the intermediate transfer belt 10. In this configuration, the fixing device 30C does not need to be configured to separate from the intermediate transfer belt 10 like the fixing device 30 of FIG. 1. Further, the position of the fixing device 30C in the printer 100 is different from that of the fixing device 30 of FIG. 1 and that of the fixing device 30B of FIG. 2. Therefore, the timing of heating a heater of the fixing device 30C is also different from that of heating a heater of the fixing device 30 and that of heating a heater of the fixing device 30B. However, the method of forming the positioning mark M, the method of detecting the positioning mark M and the processing of a detect signal of the sensor S are substantially the same as those in the embodiments of FIG. 1 and FIG. 2. Therefore, the explanation thereof is omitted.

In the configuration of FIGS. 8A–8D, the toner image of the positioning mark M will never be fixed to the intermediate transfer belt 10 by the fixing device 30C. Therefore, the positioning mark cleaning device MC can be omitted. In this case, the positioning mark M is removed by the cleaning device 25 after the fixing operation starts.

Figure 9:
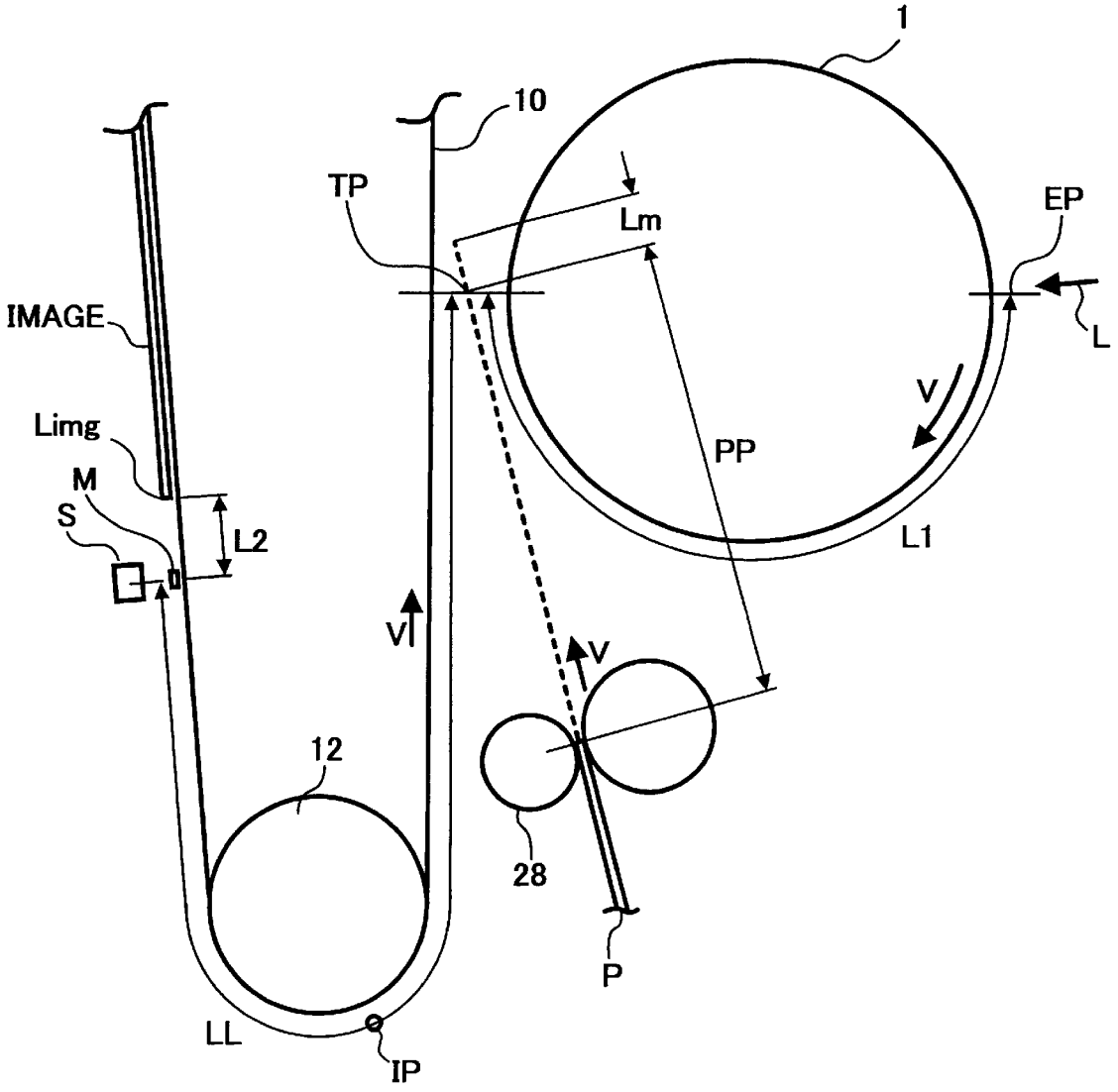
FIG. 9 is a diagram illustrating positional relations with respect to the sub-scanning direction between the positioning mark and an image, and a photoconductor drum and a recording sheet.

Now, referring to FIG. 9, the positional relations with respect to the sub-scanning direction between the positioning mark M and an image, and the photoconductor drum 1 and a recording sheet, are described.

In FIG. 9, the distance from the writing point on a surface of the photoconductor drum 1 (i.e., an incident point EP of a laser light L from the exposure device 7 (FIG. 1) to the transferring point (transfer position) TP) is represented by L1. The distance from a leading edge of a sheet P at a nip of the registration roller 28 to the transferring point TP is represented by PP. The length of a margin at a leading edge portion of the sheet P is represented by Lm, and the portion of the sheet P corresponding to the margin Lm is illustrated by a dotted line extending from the transferring point TP. Further, the distance between a leading edge "Limg" of an image (i.e., a first side image which has been formed first) transferred onto the intermediate transfer belt 10 and the positioning mark M is represented by L2. The distance L2 is constant.

Furthermore, the distance from the detecting point of the sensor S to the transferring point TP is represented by LL. FIG. 9 illustrates a state that the positioning mark M has reached the detecting point of the sensor S. The reference point IP illustrated below the driven roller 12 represents a position that is upstream of the transferring point TP by the distance L1. Here, the photoconductor drum 1, the intermediate transfer belt 10 and the sheet P travel at the same speed V in the arrow directions, respectively.

In the configuration described above, for causing the positions of leading edges of respective images on both sides of a sheet (i.e., the leading edge positions of image areas on both sides of the sheet) to coincide with each other precisely, it is sufficient to control writing of a second side image such that a leading edge thereof is written on the photoconductor drum 1 a time (LL-L1+L2)/V after the positioning mark M is detected by the sensor S, which is always at the distance L2 from the leading edge Limg of the first side image.

In FIG. 9, the distance from the leading edge Limg of the first side visual image and the transferring point TP is LL+L2, and if the time for the leading edge Limg of the first side visual image to reach the transferring point TP after the positioning mark M is detected by the sensor S is T1, T1=(LL+L2)/V. Further, the distance from the writing point EP to the transferring point TP is L1, and if the time for the leading edge of the second side visual image to reach the transferring point TP from the writing point EP is T2, then, T2=L1/V.

Because LL>L1, then T1>T2, and the time for the leading edge of the second side visual image to reach the transferring point TP is shorter than the time for leading edge of the first side visual image to reach the transferring point TP after the positioning mark M is detected by the sensor S. Accordingly, for causing the leading edge positions of the visual images on both sides of the sheet P to coincide with each other, it suffices to control writing of the second side visual image to start at a time T: {(LL+L2)−L1}/V after the positioning mark M is detected by the sensor S.

When writing the leading edge of the second side image at a position retired from that of the first side image by a distance Ln, writing of the second side visual image is controlled to start a time obtained by Ln/V later than the above time T. If writing of the leading edge of the second side visual image starts earlier than the above time T, the leading edge of the second side visual image deviates toward a position in front of the leading edge of the first side visual image, that is, in the upward direction on the sheet P. If the above-described deviation is excessively large, the leading edge of the second side visual image might not be recorded on the sheet P.

In this embodiment, the distance PP from the leading edge of the sheet P at the nip of the registration roller 28 to the transferring point TP is made shorter than the distance L1 so that the sheet P reaches the transferring point TP sufficiently in time for transferring of the first side and second side usual images thereupon.

Because the distance from the transferring point TP to the point IP is equal to the distance L1, it suffices to start conveyance of the sheet P at the registration roller 28 a predetermined time after the positioning mark M on the intermediate transfer belt 10 passes the point IP. In actuality, the positioning mark M has been removed before reaching the point IP with the positioning mark cleaning device MC (FIGS. 5A–5D). It is needless to say that a time required for obtaining the margin Lm at the leading edge of the sheet P needs to be taken into account.

Specifically, the time T1 for the leading edge of the first side visual image to reach the transfer point TP after the positioning mark M is detected by the sensor S is (LL+L2)/V, and the time for the leading edge of the sheet P at the registration roller 28 to reach the transferring point TP is PP/V. For obtaining the margin Lm at the leading of the sheet P, the time required for the leading edge of the sheet P at the registration roller 28 to reach the transferring point TP is (Lm+PP)/V. Here, (Lm+PP)/V=Tr.

Because (LL+L2)>(Lm+PP), then T1>Tr. Accordingly, for causing the leading edge position of an image coincide with the leading edge position on the sheet P where the image is to be transferred, it suffices to control the registration roller 28 to start rotating of the registration roller 28 at a time Ts: {(LL+L2)−(Lm+PP)}/V after the positioning mark M is detected by the sensor S.

If the margin Lm is to be increased by a distance y, it suffices to start rotating of the registration roller 28 earlier than the above time Ts by a time y/V. If the margin Lm is to be reduced by the distance y, it suffices to start rotating of the registration roller 28 later than the above time Ts by the time y/V. If rotating of the registration roller 28 is delayed from the time Ts excessively, i.e., by a time larger than Lm/V the leading edge of the image is advanced more than the leading edge of the sheet P, so that the leading edge of the image is not recorded on the sheet P.

Figure 10:
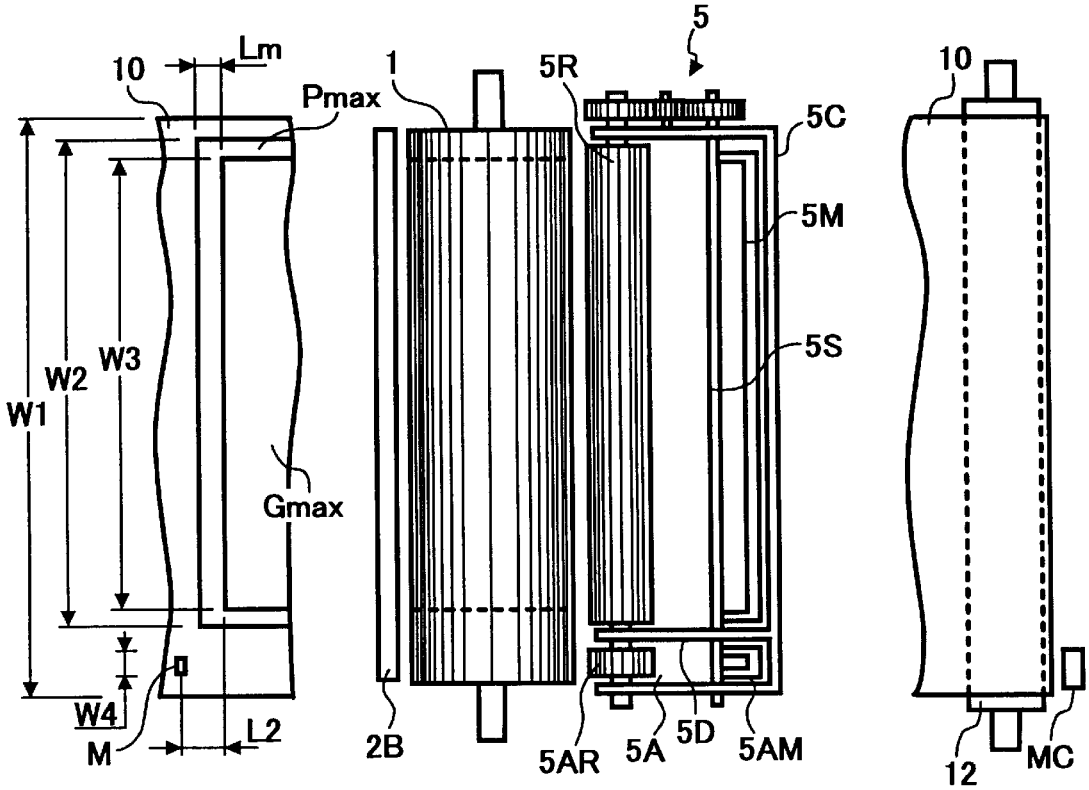
FIG. 10 is a diagram illustrating positional relations with respect to the main scanning direction between the positioning mark and an image, and the photoconductor drum and a recording sheet.

Next, referring to FIG. 10, the positional relations with respect to the main scanning direction between the positioning mark M and an image for recording, a recording sheet P, the photoconductor drum 1, and the developing device 5 are described.

In FIG. 10, the photoconductor drum 1 and the developing device 5 are illustrated in the center of the figure, and the vertical direction in the figure (i.e., the axial direction of the photoconductor drum 1) corresponds to the main scanning direction. The driven roller 12 and a part of the intermediate transfer belt 10 are illustrated at the right side of the photoconductor drum 1 and the developing device 5 in the figure. Further, at the left side of the photoconductor drum 1 and the developing device 5, another part of the intermediate transfer belt 10, a sheet Pmax being conveyed by the intermediate belt 10 while being held thereupon, and an image area Gmax on the sheet Pmax. The sheet Pmax represents a sheet of the maximum size which can be used in the printer 100, and the image area Gmax represents the maximum image area of the printer 100. The horizontal direction in the figure corresponds to the sub-scanning direction, and a sheet is conveyed from right to left in the figure.

The element denoted by reference symbol 2B at the left side of the photoconductor drum 1 in the figure is a blade of the cleaning device 2 (FIG. 1) for cleaning the photoconductor drum 1. The positioning mark cleaning device MC is arranged in the vicinity of an outer part of the driven roller 12.

The developing device 5 in this embodiment is configured to include the part for developing an image for recording and the positioning mark developing device 5A for developing the positioning mark M. The image recording part and the positioning mark developing device 5A are packaged in a case 5C and divided by a divider 5D. The reference mark 5R denotes a developing sleeve of the image developing part and the reference mark 5AR denotes a developing sleeve of the positioning mark developing device 5A. An axis 5B is common to the image developing part and the positioning mark developing device 5A. The reference mark 5M denotes a stirring bar for stirring toner of the developing device 5, and the reference mark 5AM denotes a stirring bar of the positioning mark developing device 5A. The stirring bar 5M and the stirring bar 5MA are mounted to a common axis 5S.

In the image developing part of the developing device 5, toner of a black color is accommodated for developing a latent image of the image for recording. In the positioning mark developing device SA, color toner, such as yellow toner or cyan toner, is accommodated for developing a latent image of the positioning mark M formed on the surface of the photoconductor drum 1.

As illustrated in the left side part of FIG. 10, the intermediate transfer belt 10 has a width WI, and a recording sheet is conveyed by being held on the intermediate transfer belt 10. The reference position of the recording sheet in the conveyance thereof may be either a center position or a one-sided position on the intermediate transfer belt 10. In this embodiment, the reference position of the recording sheet is the one-sided position, and the reference position is set such that an area for transferring the positioning mark M can be obtained at a side part of the intermediate transfer belt 10 even when the sheet Pmax of the maximum size is conveyed. In this embodiment, the reference position is set at an upper side of the intermediate transfer belt 10 in FIG. 10, and the area for transferring the positioning mark M is obtained at a lower part of the intermediate transfer belt 10.

In FIG. 10, on the sheet Pmax having a width W2, the image area Gmax having a width W3 is illustrated. The area corresponding to the maximum image area Gmax is indicated on the photoconductor drum 1 by dashed lines. In this embodiment, the positioning mark M is formed outside of the maximum image area Gmax. However, the positioning mark M is formed on the photoconductor drum 1 such that the positioning mark M is transferred onto a part of the intermediate transfer belt 10 out the area corresponding to the maximum size sheet Pmax on the intermediate transfer belt 10. That is, with respect to the main scanning direction, the positioning mark M is formed out of the maximum image area of the printer 100, more preferably out of the area corresponding to the maximum size sheet that can be used in the printer 100. With respect to the sub-scanning direction, regardless of the image size and the sheet size, image writing and sheet conveyance (i.e., start of rotating the registration roller 28) are controlled such that the leading edge of an image for recording is behind the positioning mark M and the leading edge of the sheet is behind the positioning mark M. In FIG. 10, the reference mark L2 denotes a distance between the leading edge of the image for recording and the positioning mark M as explained with reference to FIG. 9. The reference mark Lm denotes a margin to be formed at a leading edge part of a recording sheet.

Referring back to the positional relations in the main scanning direction, the positioning mark M is transferred onto a part of the intermediate transfer belt 10 out of the part corresponding to the maximum size sheet Pmax in the width direction of the intermediate transfer belt 10. The positioning mark M is formed in such a size and at a position that enables obtaining a margin on each side of the positioning mark M in the belt width direction. The photoconductor drum 1 has a width that enables formation of the positioning mark M in addition to accommodation of the maximum image area Gmax. The positioning mark developing device 5A has a developing width W4. The positioning mark M is formed in a shape of a line extending in the main scanning direction and having a width slightly smaller than W4. In this embodiment, the width of the line is in a range of 0.5–1.5 mm, and the length of the line is in a range of 3–6 mm. The positioning mark developing device 5A can be small, such that the developing width W4 is for example about 8 mm.

Figure 11:
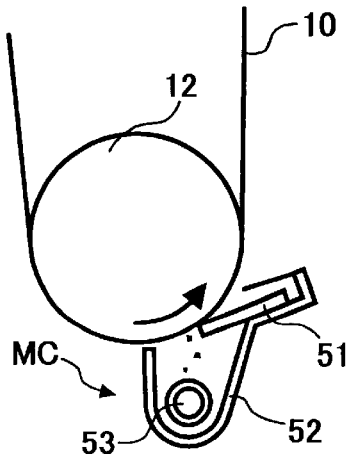
FIG. 11 is a diagram illustrating an exemplary construction of the positioning mark cleaning device.

FIG. 11 illustrates an exemplary construction of the positioning mark cleaning device MC.

The positioning mark cleaning device MC of FIG. 11 includes a blade 51 and a conveying screw 53 housed in a case 52. The blade 51 is fixed to the case 52 at an end thereof at one side and contacts the intermediate transfer belt 10 at a free end thereof at the other side with the driven roller 12 serving as a rear side roller for the intermediate transfer belt 10. In the figure, a state that the toner forming the positioning mark M is scraped off the intermediate transfer belt 10 by the blade 51 to fall down as small black points is illustrated. The scraped off toner is conveyed to a collecting part (not shown) by the conveying screw 53 to be appropriately disposed of.

The intermediate transfer belt 10 can be configured such that shifting thereof to one side (in the direction perpendicular to the belt conveying direction) is corrected in accordance with detection of the positioning mark M. In this case, because the position of the positioning mark M in the main scanning direction is detected, the shape of the positioning mark M in a form of a line extending in the main scanning direction is preferably changed, for example, to a circle or a rectangle. The diameter of such a circle and the length of one side of the rectangle are preferably in a range of 0.5–1.0 mm. When a circle or a rectangle is used for the positioning mark M, a plurality of such circles or rectangles may be arranged in the main scanning direction. Alternatively, an additional mark having a line shape extending for example in a slanted direction relative to the belt-width direction may be formed in addition to the positioning mark M in the form of a line extending in the main scanning direction. Depending upon whether a time between detecting of the positioning mark M and that of the additional mark in the slanted direction is longer or shorter than a predetermined period, it is determined that the intermediate transfer belt 10 has been shifted in the belt width direction. The mechanism for correcting shifting of the intermediate transfer belt 10 to the one side can be any of known mechanisms.

Figure 12:
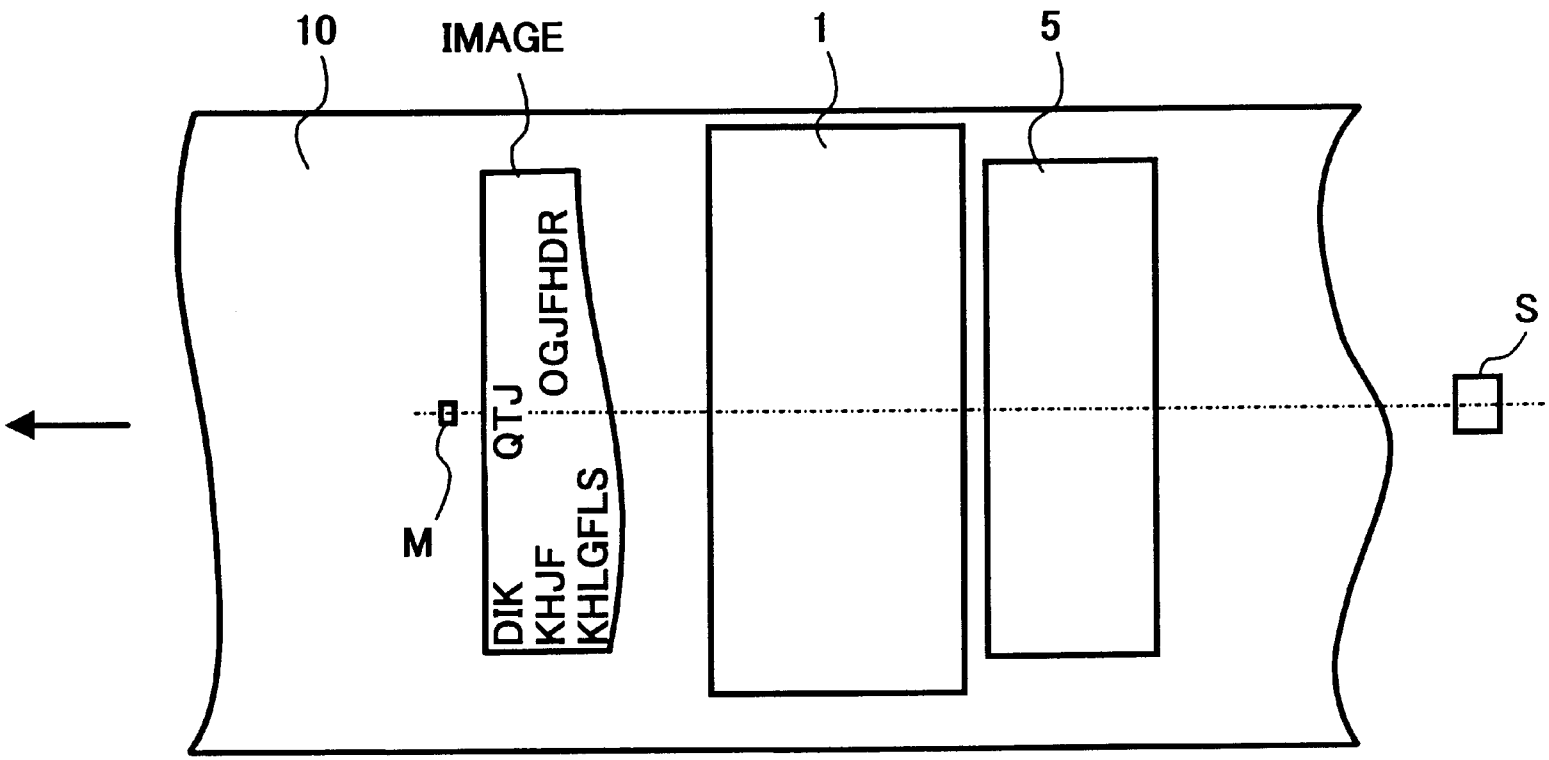
FIG. 12 is a diagram illustrating a case in which the positioning mark is formed in another position on the intermediate transfer belt.

FIG. 12 is a diagram illustrating a case in which the positioning mark M is formed in another position on the intermediate transfer belt 10.

In this case, the positioning mark M is formed at a center part of the intermediate transfer belt 10 in the belt width direction and at a margin part at the leading edge part of an image. In accordance with the position of the positioning mark M, the sensor S is also placed at a position corresponding to the center part of the intermediate transfer belt 10 in the belt-width direction. The position of the sensor S in the circumferential direction of the intermediate transfer belt 10 is substantially the same as illustrated in FIGS. 5A–5D and FIGS. 8A–8D.

In the example illustrated in FIG. 12, the positioning mark cleaning device MC cannot always contact the intermediate transfer belt 20, because if a toner image of an image for recording carried on the intermediate transfer belt 10 is conveyed to the position corresponding to the positioning mark cleaning device MC, the toner image is disturbed by the positioning mark cleaning device MC.

Therefore, when the positioning mark M is formed at the center part of the intermediate transfer belt 10 as in FIG. 12, the positioning mark cleaning device MC must be configured to contact and separate from the intermediate transfer belt 10. When a fixing device is arranged out of the loop of the intermediate transfer belt 10 as in FIGS. 8A–8D, the positioning mark cleaning device MC is omitted and the positioning mark M is removed by the cleaning device 25.

Figure 13:
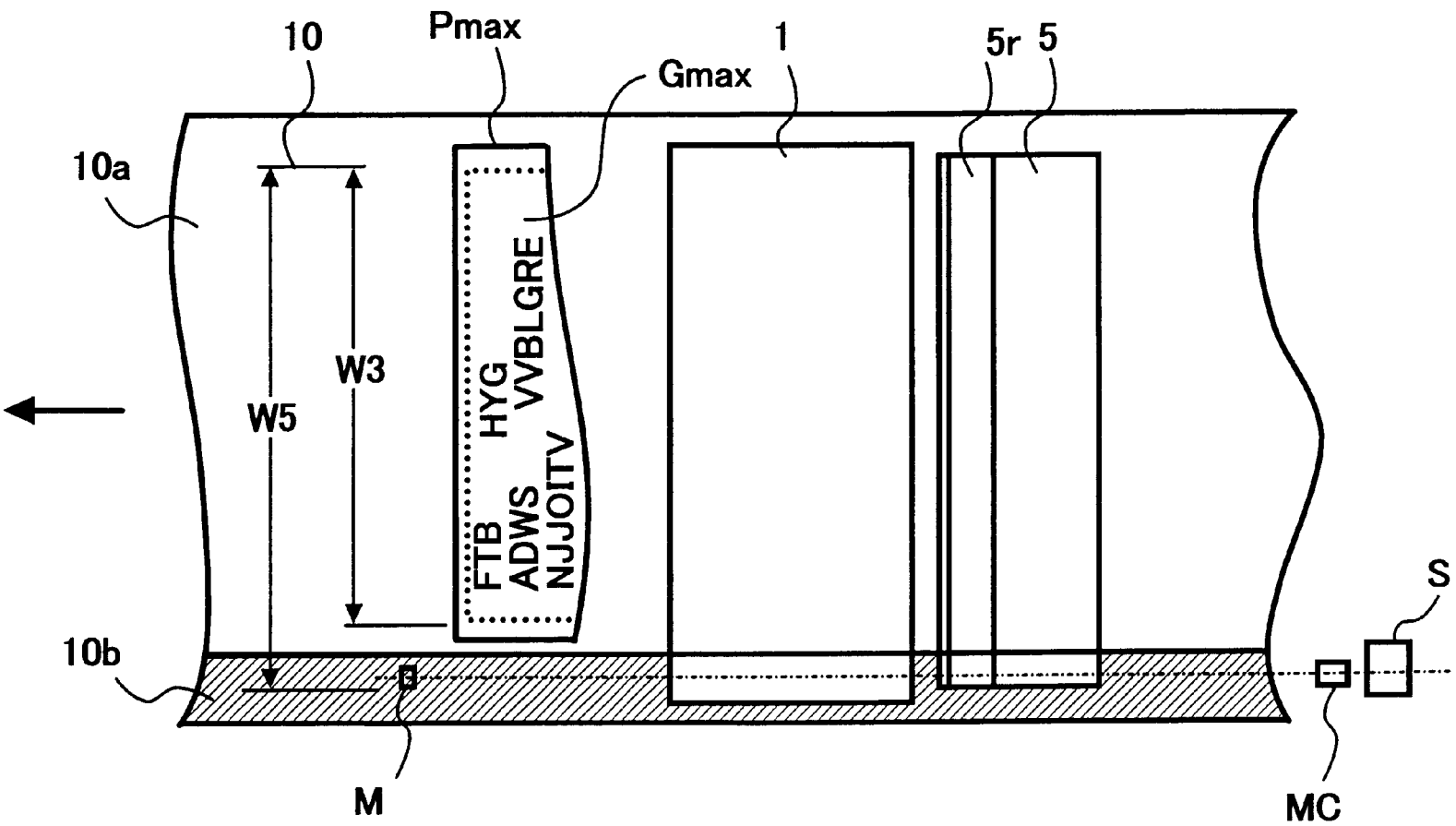
FIG. 13 is a diagram illustrating an example in which the positioning mark is formed in such a position that the mark can be developed by a developing device without provision of a dedicated positioning mark developing device and that the mark is transferred to a side part of the intermediate transfer belt.

FIG. 13 is a diagram illustrating an example in which the positioning mark M is formed in such a position that the mark M can be developed by the developing device 5 without provision of the positioning mark developing device 5A and that the mark M is transferred to a side part of the intermediate transfer belt 10. In this example, a side part 10*b* of the intermediate transfer belt 10 where the positioning mark M is transferred thereto is formed in a color that is different from the other part 10*a* of the intermediate transfer belt 10.

The developing device 5 in this example has a developing width W5 that enables development of the positioning mark M in addition to development of the maximum image area Gmax. The developing device 5 includes only one developing sleeve 5*r*, and the image for recording and the positioning mark M are both developed with toner applied by the developing sleeve 5*r* in a same color (e.g., a black color in a monochrome image forming apparatus). The color of the end part 10*b* of the intermediate transfer belt 10 is preferable to be formed in such a color that enables reliable detection of the positioning mark M developed with the black toner.

In the above-described printer 100, whether to perform image formation for one side of a recording sheet or for both sides of the recording sheet is determined by inputting of a predetermined command from a host computer (not shown) or from an operational panel (not shown) of the printer 100. Alternatively, the printer 100 can be configured such that the order of priority between image formations for one side and both sides of a recording sheet is predetermined and is set as a default condition.

When an image forming operation is selected as above (i.e., to perform image formation for one side of a recording sheet or for both sides of the recording sheet) the operation condition of the fixing device 30 or 30B is changed according to the selected image forming operation. That is, when forming images on both side of a recording sheet, because larger energy is required for the fixing operation as compared when forming an image on one side of the recording sheet, the inputting voltage to a heat source of the fixing device 30 or 30B is increased, or the frequency of inputting the voltage is increased.

In particular, in the fixing operation in a case where image formation has been performed only for one side of a recording sheet, heating of the fixing roller 18 provided inside of the loop of the intermediate transfer belt 10 is decreased or stopped in the embodiments of FIG. 1 and FIG. 5. It is more advantageous in energy saving to configure the fixing device 30 or 30B, which is outside of the loop of the intermediate transfer belt 10, and the fixing roller 18, which is inside of the loop of the intermediate transfer belt 10, such that respective temperatures can be individually controlled.

The present invention has been described with respect to the embodiments illustrated in the figures. However, present invention is not limited to the embodiments and may be practiced otherwise.

For example, the configuration for forming the positioning mark M is not limited to that of the above embodiments in which the mark M is formed by the exposure device 7 on the photoconductor drum 1 as a toner image. More specifically, a toner image of the positioning mark M can be directly formed on a first image bearing member (i.e., the photoconductor drum 1) or a second image bearing member (i.e., the intermediate transfer belt 10), without performing an exposure operation, by providing a pattern (e.g., an eletrostatic printing pattern) on the first image bearing member or on the second image bearing member, and by applying toner thereto or removing the toner therefrom.

Further, the color and the shape of the positioning mark M are not limited to those described above. Also, any appropriate device can be used for detecting the positioning mark M, and for removing the positioning mark M from the intermediate transfer belt 10 as well. Furthermore, the position of the positioning mark M can be any place on the intermediate transfer belt 10 as long as the mark M will not disturb a toner image for recording formed on the intermediate transfer belt 10.

Further, when recording images on both sides of a sheet, instead of turning one around the intermediate transfer belt 10 carrying thereupon a first side image and a positioning mark, the intermediate transfer belt 10 can be rotated in the reverse direction to convey the first side image to a predetermined position. In this case, a mechanism is required to allow a first image bearing member (e.g., the photoconductor drum 1) to separate from the second image bearing member (e.g., the intermediate transfer belt 10).

Furthermore, in the above embodiments, the first image bearing member is configured to be a photoconductor drum. However, the first image bearing member can be configured to be a belt. The charging polarity of the photoconductor drum 1 and that of the toner, and the polarity of the transfer voltage are just examples and can be reversed, respectively.

Further, in the above embodiments, the exposure device 7 uses a laser system. However, an LED system may be also used.

Furthermore, the present invention can be practiced in an analogue type image forming apparatus using an analogue type exposure device. In this case, an original image for a positioning mark is placed at a position outside of an original document area so as to be exposed, or the positional mark is directly formed without an exposure operation as described above.

The present invention has been described with respect to the printer 100 as an example of an image forming apparatus. However, it is needless to say that the present invention can be applied to other image forming apparatuses such as a copier, a facsimile machine, etc.

Obviously, numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Applications No. 2000-288910 and No. 2001-250332 filed in the Japanese Patent Office on Sep. 22, 2000 and Aug. 21, 2001, respectively, and the entire contents of which are hereby incorporated herein by reference.

What is claimd as new and is desired to be secured as Letters Patent of the United States is:

1. An image forming apparatus, comprising:

a first image bearing member;

a second image bearing member;

an exposure device configured to form a latent image of an image;

a developing device configured to visualize a latent image into a visual image; and a first transfer device configured to transfer visual images from the first image bearing member onto the second image bearing member and onto a second side of a recording medium;

wherein a latent image of a positioning mark is formed by the exposure device and visualized to a visual positioning mark image by the developing device, and the visual positioning mark image is transferred from the first image bearing member by the first transfer device to form a positioning mark on the second image bearing member at a position outside an image forming area having a size corresponding to that of a maximum size recording medium useable with the image forming apparatus, said image forming area containing a first side visual image transferred by the first transfer device from the first image bearing member, wherein a second side visual image formed by the exposure device and the developing device is transferred from the first image bearing member onto the second side of the recording medium by the first transfer device and the first side visual image is transferred from the image forming area onto a first side of the recording medium by a second transfer device, so that the first and second side visual images are obtained on the first and second sides of the recording medium, respectively, and wherein when forming the first side and second side visual images on the first and second sides of the recording medium, an image forming operation is controlled according to detection of the positioning mark with a positioning mark detecting device such that positions of the first and second side visual images on the first and second sides of the recording medium coincide with each other.

2. The image forming apparatus according to claim 1, wherein conveyance of the recording medium is controlled according to the detection of the positioning mark with the positioning mark detecting device such that positions of the first side and second side visual images on the first and second sides of the recording medium coincide with each other.

3. The image forming apparatus according to claim 2, wherein when forming one of the first side and second side visual images on the recording medium, conveyance of the recording medium is controlled according to the detection of the positioning mark with the positioning mark detecting device such that a leading edge of one of the first side and second side visual images is placed at a predetermined position on the recording medium.

4. The image forming apparatus according to claim 1, further comprising:

a fixing device, wherein the first side and second side visual images transferred onto the first and second sides of the recording medium are fixed onto the recording medium, respectively, by the fixing device in a state that the second image bearing member and the recording medium are overlapped with each other.

5. The image forming apparatus according to claim 1, further comprising:

a positioning mark cleaning device configured to remove the positioning mark formed on the second image bearing member.

6. The image forming apparatus according to claim 5, wherein the second image bearing member is formed as an endless belt, and wherein the positioning mark cleaning device is placed downstream and in a vicinity of the positioning mark detecting device in a rotating direction of the second image bearing member formed as the endless belt.

7. The image forming apparatus according to claim 1, wherein a color of the positioning mark is different from that of a surface of the second image bearing member.

8. The image forming apparatus according claim 7, wherein the developing device includes a positioning mark developing portion configured to visualize the positioning mark in the color different from that of the surface of the second image bearing member.

9. The image forming apparatus according to claim 1, wherein a color of a surface of the second image bearing member is different from that of the first side visual image transferred thereupon from the first image bearing member.

10. The image forming apparatus according to claim 1, wherein a surface of the part of the second image bearing member where the positioning mark is formed is at one side of the image forming area and has a color different from that of the first side visual image transferred from the first image bearing member onto the image forming area.

11. The image forming apparatus according to claim 1, wherein the positioning mark position outside of the image forming area is in front of the image forming area.

12. The image forming apparatus according to claim 1, further comprising:

a cooling device configured to circulate air to cool the second image bearing member, wherein the cooling device is not operated when at least one of the positioning mark and the first side visual image on the second image bearing member passes a cooling area of the cooling device.

13. The image forming apparatus according to claim 1, wherein the second image bearing member is formed as an endless belt and is arranged so as to extend in a vertical direction, and wherein the positioning mark detecting device is placed such that a sensing surface of the positioning mark detecting device is substantially in parallel with a surface of the second image bearing member formed as the endless belt.

14. The image forming apparatus according to claim 1, further comprising:

a cleaning device configured to clean the second image bearing member, wherein the cleaning device removes the positioning mark formed on the second image bearing member.

15. An image forming apparatus, comprising:

a first image bearing member;

a second image bearing member;

means for forming a latent image of an image on the first image bearing member;

means for visualizing the latent image formed on the first image bearing member into a visual image; and first means for transferring visual images from the first image bearing member onto the second image bearing member and onto a second side of a record medium;

wherein a latent image of a positioning mark is formed with the means for forming a latent image on the first image bearing member and is visualized to a visual image of the positioning mark by a second means for visualizing, and the visual image of the positioning mark is transferred from the first image bearing member to the second image bearing member by the first means for transferring to form the positioning mark on the second image bearing member at a position outside an image forming area having a size corresponding to that of a maximum size image that can be formed on the recording medium useable with the image forming apparatus and containing a first side visual image thereon transferred by the first transfer means from the first image bearing member for transferring from the image forming area onto a first side of the recording medium, wherein a second side visual image formed on the first image bearing member by the means for forming a latent image and the means for visualizing is transferred from the first image bearing member onto the second side of the recording medium by the first means for transferring and the first side visual image is transferred from the image forming area onto a first side of the recording medium by a second means for transferring visual images, so that the first and second side visual image are obtained on the first and second sides of the recording medium, respectively, and wherein when forming the first side and second side visual images on the first and second sides of the recording medium, an image forming operation is controlled according to detection of the positioning mark on the second image bearing member with a means for detecting the positioning mark such that positions of the first side and second side visual images on the first and second sides of the recording medium coincide with which other.

16. The image forming apparatus according to claim 15, further comprising:

means for removing the positioning mark formed on the second image bearing member.

17. The image forming apparatus according to claim 15, wherein a color of the positioning mark is different from that of a surface of the second image bearing member.

18. The image forming apparatus according C1aim 17, wherein the means for visualizing includes means for visualizing the positioning mark in the color different from that of the surface of the second image bearing member.

19. The image forming apparatus according to claim 15, further comprising:

means for circulating air to cool the second image bearing member, wherein the means for circulating is not operated when at least one of the positioning mark and the first side visual image on the second image bearing member passes a cooling area of the means for circulating.

20. The image forming apparatus according to claim 15, further comprising:

means for cleaning the second image bearing member, wherein the means for cleaning removes the positioning mark formed on the second image bearing member.

21. An image forming method for obtaining a first side visual image and a second side visual image on a first side and a second side of a recording medium by p transferring the first side visual image from a first image bearing member to a second image bearing member and from the second image bearing member onto the first side of the recording medium, and transferring the second side visual image from the first image bearing member to the second side of the recording medium, the method comprising the steps of:

forming the first side visual image in an image forming area on the second image bearing member, the image forming area having a size corresponding to that of a maximum recording medium useable with the image forming apparatus;

forming a positioning mark on the second image bearing member at a position outside the image forming area;

detecting the positioning mark; and controlling formation of the second side visual image on the second side of the second medium according to detection of the positioning mark such that positions of the first side and second side visual images on the first and second sides of the recording medium coincide with each other.

22. The image forming method according to claim 21, wherein in the controlling step conveyance of the recording medium is controlled according to the detection of the positioning mark such that positions of the first side and second side visual images on the first and second sides of the recording medium coincide with each other.

23. The image forming method according to claim 21, wherein when forming one of the first and second side visual images on the recording medium, in the controlling step the conveyance of the recording medium is controlled according to the detection of the positioning mark such that a leading edge of the one of the first side and second side visual images is placed at a predetermined position on the recording medium.

24. The image forming method according to claim 21, further comprising the step of:

fixing the first side and second side visual images transferred onto the first and second sides of the recording medium, respectively, in a state that the second image bearing member and the recording medium are overlapped with each other.

25. The image forming method according to claim 21, wherein the forming of the positioning mark step includes:

forming a latent image of the positioning mark with an exposure device on the first image bearing member;

developing a latent image of the positioning mark to a visual image of the positioning mark with a developing device; and transferring the visual image of the positioning mark from the first image bearing member to the second image bearing member with a transfer device, thereby forming the positioning mark at a position outside the image forming area containing the first side visual image on the second image hearing member.

26. The image forming method according to claim 21, further comprising the step of:

removing the positioning mark formed on the second image bearing member.

27. The image forming method according to claim 26, wherein the second image bearing member is formed as an endless belt, and wherein a positioning mark removing device is placed downstream of a positioning mark detecting device in a vicinity thereof in a rotating direction of the second image bearing member formed as the endless belt.

28. The image forming method according to claim 21, wherein the positioning mark position is at one side of the image formation area in an image width direction.

29. The image forming method according to claim 21, wherein in the forming of the positioning mark step, a color of the positioning mark is different from that of a surface of the second image bearing member.

30. The image forming method according to claim 29, wherein in the forming of the positioning mark step, the positioning mark is visualized in the color different from that of the surface of the second image bearing member with a positioning mark developing device.

31. The image forming method according to claim 21, wherein a color of a surface of the second image bearing member is different from that of the first side visual image transferred from the first image bearing member.

32. The image forming method according to claim 31, wherein the positioning mark position is at one side of the image formation area in an image with direction, and wherein a surface of a part of the second image bearing member at one side thereof where the positioning mark is formed is provided with the color different from that of the first side visual image transferred from the first image bearing member.

33. The image forming method according to claim 21, wherein the positioning mark position is in front of the first side visual image on the second image bearing member.

34. The image forming method according to claim 21, further comprising the step of:

circulating air to cool the second image bearing member with a cooling device, wherein the cooling device is not operated when at least one of the positioning mark and the first side visual image on the second image bearing member passes a cooling area of the cooling device.

35. The image forming method according to claim 21, wherein the second image bearing member is formed as an endless belt and is arranged so as to extend in a vertical direction, and wherein the positioning mark detecting step is performed with a positioning mark detecting device placed such that a sensing surface of the positioning mark detecting device is substantially in parallel with a surface of the second image bearing member formed as the endless belt.

36. The image forming method according to claim 21, further comprising the step of:

cleaning the second image bearing member with a cleaning device, wherein the cleaning device removes the positioning mark formed on the second image bearing member.

* * * * *

UNITED STATES PATENT AND TRADEMARK OFFICE

CERTIFICATE OF CORRECTION

PATENT NO. : 6,608,985 B2
DATED : August 19, 2003
INVENTOR(S) : Mochimaru et al.

It is certified that error appears in the above-identified patent and that said Letters Patent is hereby corrected as shown below:

Title page,
Item [30], Foreign Application Priority Data should read:
-- [30] Foreign Application Priority Data
Sept. 22, 2000 (JP)……...P2000-288910
Aug. 21, 2001 (JP)……...P2001-250332 --

Signed and Sealed this

Sixteenth Day of December, 2003

JAMES E. ROGAN
*Director of the United States Patent and Trademark Office*